US009878563B2

(12) United States Patent
Takahashi et al.

(10) Patent No.: US 9,878,563 B2
(45) Date of Patent: Jan. 30, 2018

(54) PRINTER

(71) Applicant: FUJITSU COMPONENT LIMITED, Tokyo (JP)

(72) Inventors: Kohei Takahashi, Tokyo (JP); Masahiro Kaneko, Tokyo (JP); Nobuo Yatsu, Tokyo (JP); Takuya Uchiyama, Tokyo (JP); Yayoi Tokuhara, Tokyo (JP); Ying Li, Tokyo (JP); Katsuaki Koshimura, Tokyo (JP); Chuqi Liang, Tokyo (JP); Miki Kitahara, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/319,894

(22) PCT Filed: Jul. 6, 2015

(86) PCT No.: PCT/JP2015/069410
§ 371 (c)(1),
(2) Date: Dec. 19, 2016

(87) PCT Pub. No.: WO2016/006572
PCT Pub. Date: Jan. 14, 2016

(65) Prior Publication Data

US 2017/0144456 A1 May 25, 2017

(30) Foreign Application Priority Data

Jul. 7, 2014 (JP) ..... 2014-139947
Aug. 6, 2014 (JP) ..... 2014-160775

(51) Int. Cl.
*B41J 11/04* (2006.01)
*B41J 2/32* (2006.01)

(52) U.S. Cl.
CPC *B41J 11/04* (2013.01); *B41J 2/32* (2013.01)

(58) Field of Classification Search
CPC ..... B41J 2/32; B41J 11/70; B41J 15/00; B41J 15/04; B41J 29/02
See application file for complete search history.

(56) References Cited

U.S. PATENT DOCUMENTS

| | | | |
|---|---|---|---|
| 6,765,602 | B2 | 7/2004 | Mori |
| 6,814,515 | B2 | 11/2004 | Tsuchiya et al. |
| 2014/0232806 | A1 | 8/2014 | Tsuchiya et al. |

FOREIGN PATENT DOCUMENTS

| | | |
|---|---|---|
| JP | S62-059060 | 3/1987 |
| JP | 2000-318239 | 11/2000 |

(Continued)

OTHER PUBLICATIONS

Partial English Translation of The Written Opinion of The International Searching Authority of International Application No. PCT/JP2015/069410 dated Oct. 6, 2015.

*Primary Examiner* — Lamson Nguyen
(74) *Attorney, Agent, or Firm* — IPUSA, PLLC

(57) ABSTRACT

A printer includes a print head, a platen roller, a frame, a release lever, and a spring. The print head performs printing on recording paper. The platen roller conveys the recording paper held between the platen roller and the print head. The print head and the platen roller are placed on the frame. The frame includes a side plate in which a frame groove is formed. The release lever moves relative to the frame. The spring is provided between the frame and the print head to urge the print head toward the platen roller. The platen roller is placed on the frame while being held between the frame groove and the release lever. The release lever moves to unblock the frame groove.

14 Claims, 42 Drawing Sheets

(56) References Cited

FOREIGN PATENT DOCUMENTS

| | | |
|---|---|---|
| JP | 2003-019845 | 1/2003 |
| JP | 2004-195805 | 7/2004 |
| JP | 2013-082112 | 5/2013 |

PRINTER

TECHNICAL FIELD

The present invention relates to printers.

BACKGROUND ART

Printers that output receipts are widely used for shop registers and automated teller machines (ATMs) or cash dispensers (CDs) in banks. Printers that output receipts perform printing on recording paper with a head while conveying the recording paper held between a platen roller and the head by rotating the platen roller. The recording paper subjected to printing is cut by a cutter to a predetermined length. The cutter includes a fixed blade and a movable blade, and the movable blade moves toward the fixed blade to cut the recording paper held between the fixed blade and the movable blade.

PRIOR ART DOCUMENT

Patent Document

[Patent Document 1] Japanese Laid-Open Patent Application No. 2003-19845

SUMMARY OF THE INVENTION

Problems to be Solved by the Invention

According to such printers using a thermal head, a platen roller is separated from the head at the time of maintenance or replenishing recording paper.

Normally, the platen roller is supported by the side plates of a printer frame and the side plates of a platen release lever for releasing the platen roller, and the platen roller can be detached by moving the platen release lever. At this point, an inability to easily detach the platen roller, which hinders maintenance or replenishment of recording paper to make it troublesome to use the printer and make the printer less easily operable, is undesirable.

Therefore, there is a demand for a printer that allows an easy detachment of a platen roller at the time of detaching the platen roller by operating a platen release lever.

Means for Solving the Problems

According to an aspect of the present invention, a printer includes a print head, a platen roller, a frame, a release lever, and a spring. The print head performs printing on recording paper.

The platen roller conveys the recording paper held between the platen roller and the print head. The print head and the platen roller are placed on the frame. The frame includes a side plate in which a frame groove is formed. The release lever moves relative to the frame. The spring is provided between the frame and the print head to urge the print head toward the platen roller. The platen roller is placed on the frame while being held between the frame groove and the release lever. The release lever moves to unblock the frame groove.

According to an aspect of the present invention, a printer includes a print head, a platen roller, a frame, and a release lever. The print head performs printing on recording paper. The platen roller conveys the recording paper. The frame includes a frame plate, and a first side plate and a second side plate provided on a first end portion and a second end portion, respectively, of the frame plate. The print head and the platen roller are placed on the frame. The release lever is attached to the frame outside the first side plate to be movable in a direction away from the first side plate. The platen roller is supported by the release lever and frame grooves formed in the first and second side plates. The release lever moves in the direction away from the first side plate to allow the removal of the platen roller from the frame grooves.

Effects of the Invention

According to an aspect of the present invention, a platen roller is easily detachable in a printer at the time of detaching the platen roller by operating a platen release lever.

EMBODIMENTS OF THE INVENTION

Figure 1:
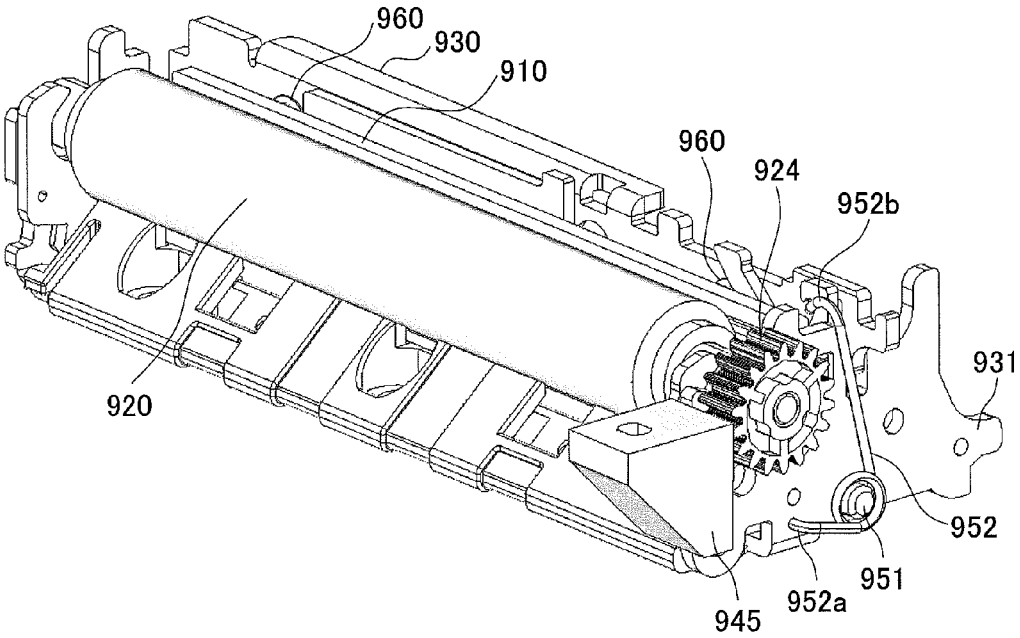
FIG. 1 is a perspective view of a printer.

Embodiments of the present invention are described below. The same member or the like is referred to using the same reference numeral, and a repetitive description thereof is omitted.

First, a printer that uses a thermal head is described with reference to FIGS. 1 through 9. As depicted in FIG. 1, this printer includes a thermal head 910 and a platen roller 920, and performs printing on recording paper with the thermal head 910 while rotating the platen roller 920 to convey the recording paper held between the thermal head 910 and the platen roller 920.

Figure 2:
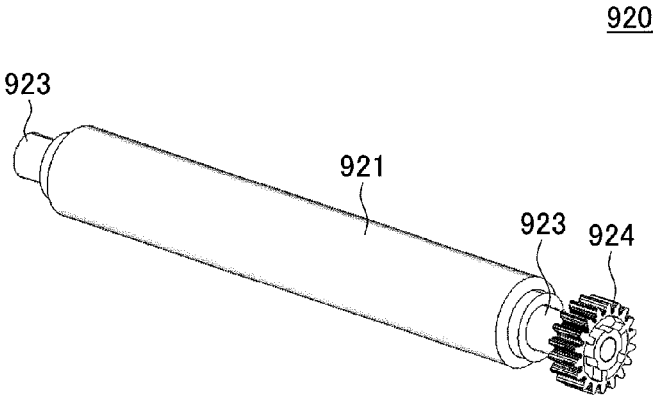
FIG. 2 is a diagram illustrating a platen roller of the printer.
Figure 3:
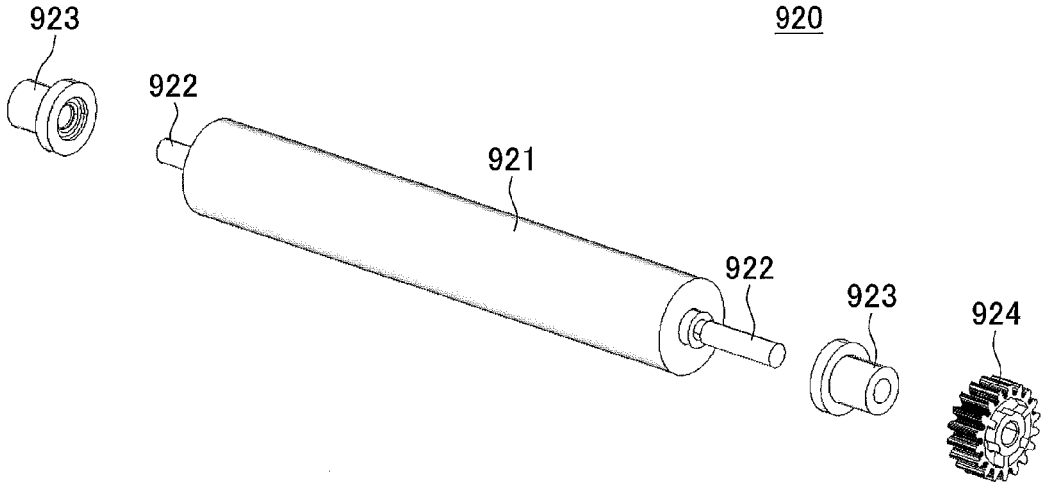
FIG. 3 is a diagram illustrating the platen roller of the printer.

FIG. 2 is a perspective view of the platen roller 920, and FIG. 3 is an exploded perspective view of the platen roller 920. As depicted in FIGS. 2 and 3, the platen roller 920 includes platen shafts 922 one provided at each end of a roller 921, and each platen shaft 922 is capped with a platen cap 923. Furthermore, a gear 924 is connected to one of the platen shafts 922. According to this printer, when printing is performed with the thermal head 910, the rotation of a conveyance motor is transmitted to the gear 924 at the platen roller 920 to rotate the gear 924, so that printing is performed on recording paper while conveying the recording paper with the platen roller 920.

Figure 4:
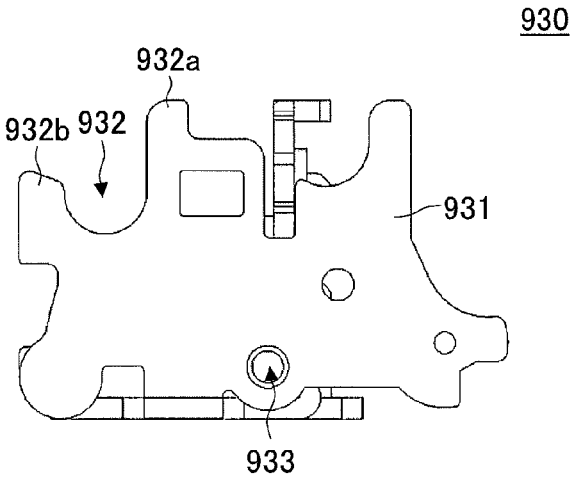
FIG. 4 is a diagram illustrating the printer.
Figure 5:
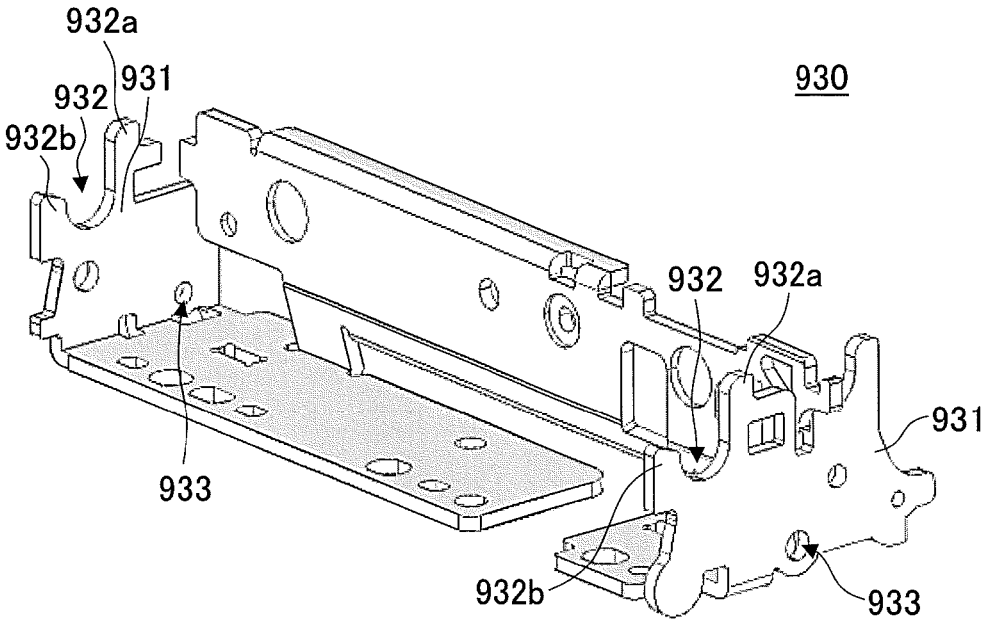
FIG. 5 is a diagram illustrating the printer.

FIG. 4 is a side view of a frame 930 of the printer, and FIG. 5 is a perspective view of the frame 930.

As depicted in FIGS. 4 and 5, the frame. 930 includes frame side plates 931 one at each end of the frame 930. Each frame side plate 931 is provided with a frame groove 932 for placing the platen roller 920. Furthermore, each frame side plate 931 is provided with an opening hole 933 for inserting a below-described pivot shaft 951.

Figure 6:
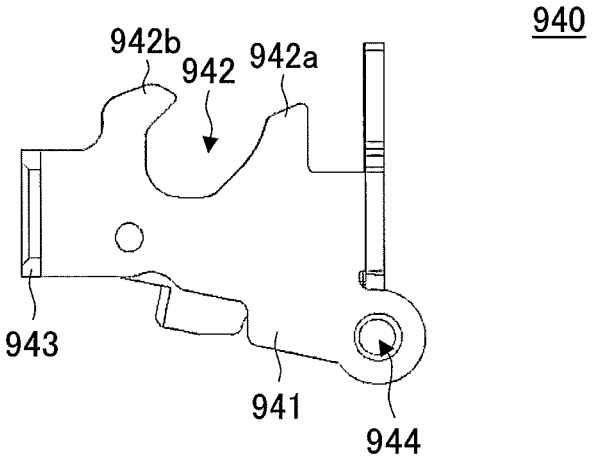
FIG. 6 is a diagram illustrating the printer.
Figure 7:
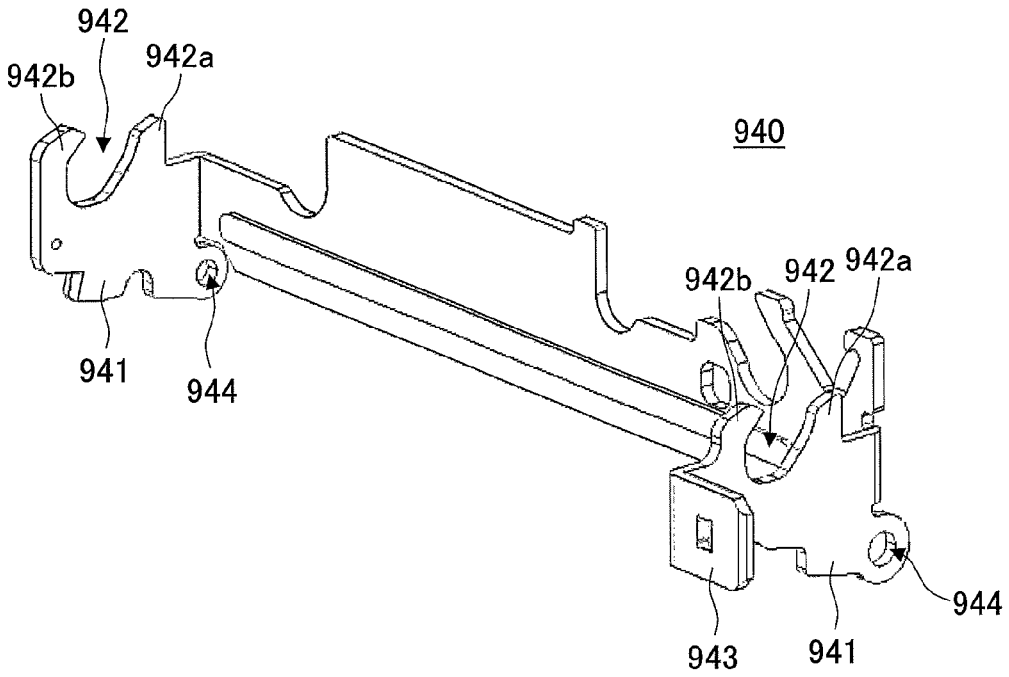
FIG. 7 is a diagram illustrating the printer.
Figure 8:
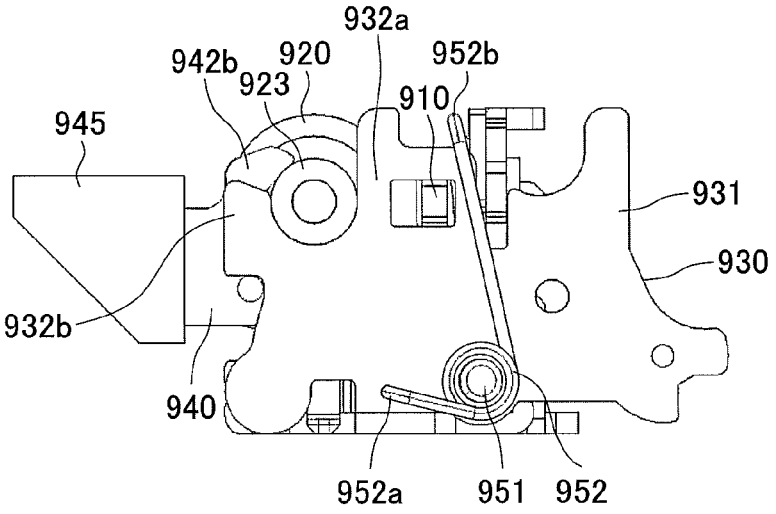
FIG. 8 is a diagram illustrating the printer.
Figure 9:
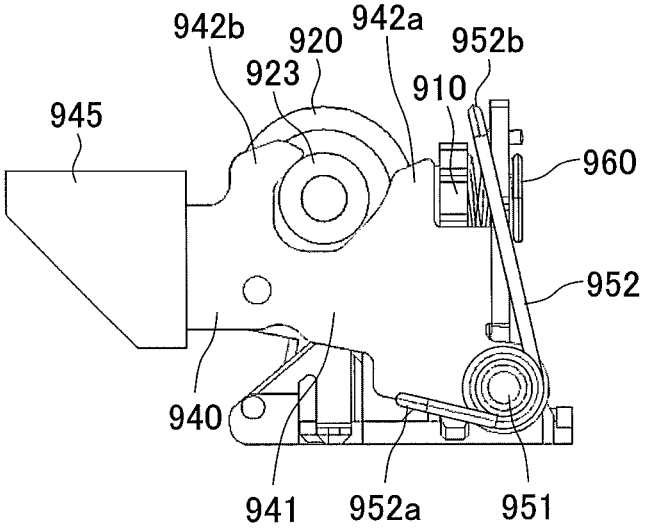
FIG. 9 is a diagram illustrating the printer.

FIG. 6 is a side view of a release lever 940 of the printer, and FIG. 7 is a perspective view of the release lever 940. FIG. 8 is a side view of the printer, and FIG. 9 is a side view of the printer from which the frame 930 is removed. As depicted in FIGS. 6 and 7, the release lever 940 includes lever side plates 941 one provided at each end of the release lever 940. Each lever side plate 941 is provided with a lever groove 942 for supporting the platen roller 920. Furthermore, each lever side plate 941 is provided with an opening hole 944 for inserting the pivot shaft 951. As depicted in FIGS. 8 and 9, the release lever 940 is so connected to the frame 930 as to be pivotable about the pivot shaft 951. It is possible to pivot the release lever 940 about the pivot shaft 951 by depressing a lever cap 945 capping a lever operation part 943.

According to this printer, the platen roller 920 is rotatably placed at a predetermined position with the platen caps 923 of the platen roller 920 being placed in the frame grooves 932 of the frame side plates 931 of the frame 930 and in the lever grooves 942 of the lever side plates 941 of the release lever 940.

A torsion coil spring 952 is provided around the pivot shaft 951. The torsion coil spring 952 has one end 952*a* connected to one of the frame side plates 931 and another end 952*b* connected to the release lever 940. Accordingly, when the lever cap 945 of the release lever 940 is depressed, the release lever 940 pivots about the pivot shaft 951, and when a force that keeps the lever cap 945 depressed disappears, the release lever 940 is returned to its original state by the restoring force of the torsion coil spring 952.

Furthermore, as depicted in FIGS. 1 and 9, coil springs 960 are placed between the thermal head 910 and the frame 930, so that the thermal head 910 is pressed toward the platen roller 920 by the restoring forces of the coil springs 960.

As depicted in, for example, FIGS. 4 and 5, each frame groove 932 is formed in a substantial U shape between a support part 932*a* on the thermal head 910 side and a support part 932*b* on the side opposite to the thermal head 910 side, that is, opposite the support part 932*a*. Each frame groove 932 is open in a direction substantially perpendicular to a direction in which the restoring forces of the coil springs 960 act, and the platen caps 923 are placed between the support parts 932*a* and the support parts 932*b*.

Furthermore, as depicted in, for example, FIGS. 6 and 7, each lever groove 942 as well is formed in a substantial U shape between a support part 942*a* on the thermal head 910 side and a support part 942*b* on the side opposite to the thermal head 910 side, that is, opposite the support part 942*a*. The platen caps 923 are placed between the support parts 942*a* and the support parts 942*b*. According to this printer, the platen caps 923 placed in the frame grooves 932 are so pressed by the support parts 942*b* as to be covered from above with the support parts 942*b*. Therefore, the platen roller 920 can be placed at a predetermined position without coming off the frame grooves 932.

According to this printer, the lever cap 945 is depressed to pivot the release lever 940 about the pivot shaft 951, so that the support parts 942*b* covering the platen caps 923 from above move to unblock the frame grooves 932 on their upper side. That is, the platen caps 923 are allowed to move upward from the frame grooves 932. As a result, it becomes possible to detach the platen roller 920. The direction in which the restoring forces of the coil springs 960 act and the direction in which the platen roller 920 is detached, however, are substantially at right angles. Therefore, it takes time and effort to remove the platen roller 920 from the frame grooves 932, thus making the printer less easily operable.

[First Embodiment]

Figure 10:
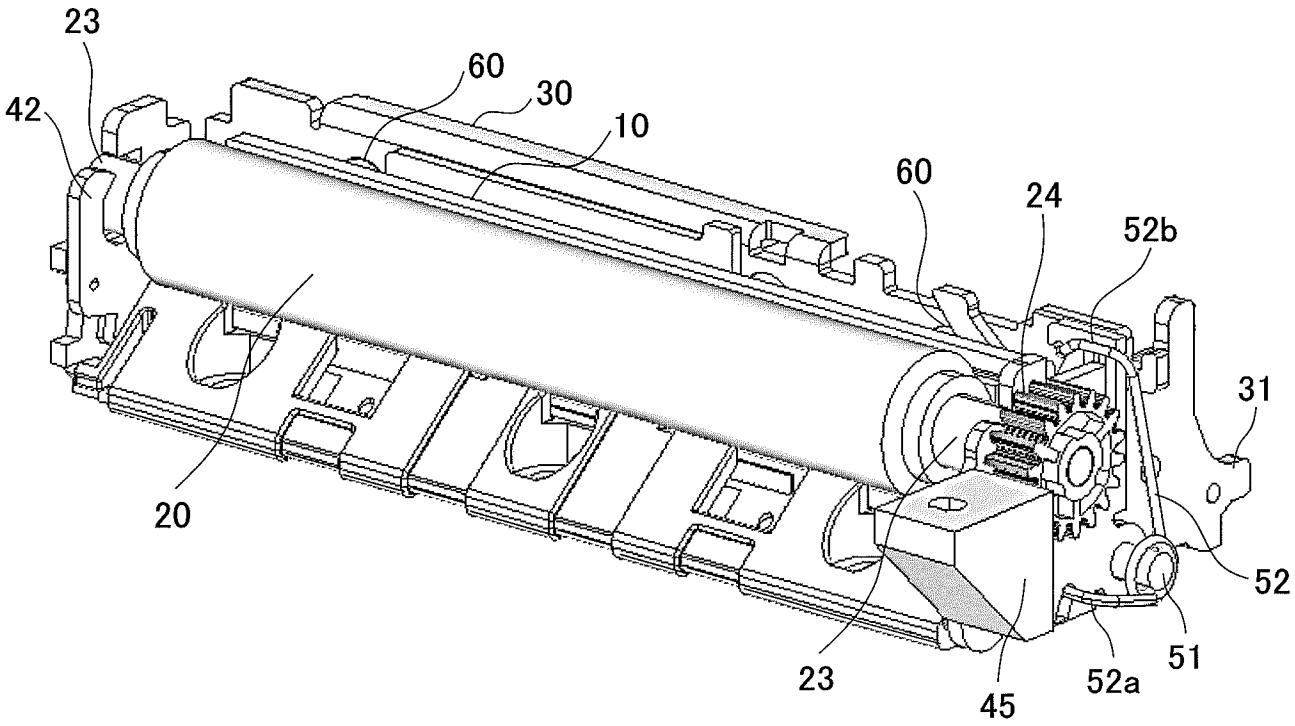
FIG. 10 is a perspective view of a printer according to a first embodiment.

Next, a printer according to a first embodiment is described with reference to FIGS. 10 through 16. As depicted in FIG. 10, a printer according to this embodiment includes a thermal head 10, which is a print head, and a platen roller 20, and performs printing on recording paper with the thermal head 10 while rotating the platen roller 20 to convey the recording paper held between the thermal head 10 and the platen roller 20.

Figure 11:
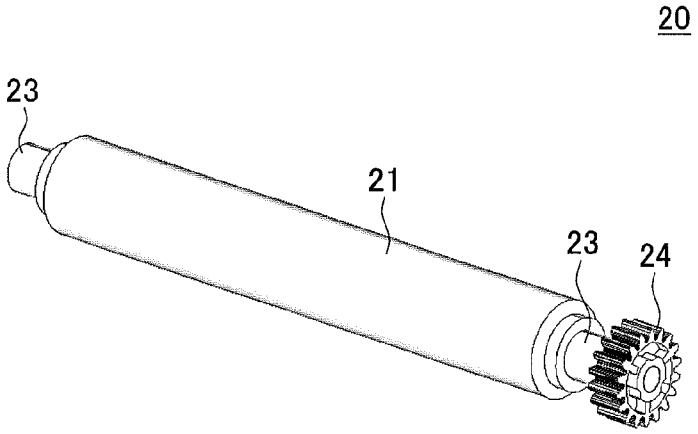
FIG. 11 is a diagram illustrating a platen roller of the printer according to the first embodiment.
Figure 12:
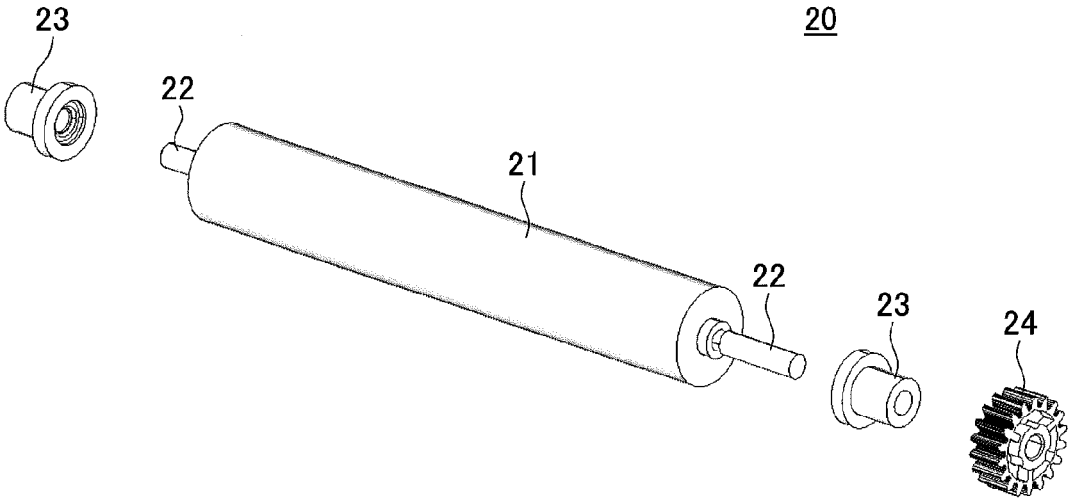
FIG. 12 is a diagram illustrating the platen roller of the printer according to the first embodiment.

FIG. 11 is a perspective view of the platen roller 20, and FIG. 12 is an exploded perspective view of the platen roller 20. As depicted in FIGS. 11 and 12, the platen roller 20 includes a roller 21 and platen shafts 22 one provided at each end of the roller 21, and each platen shaft 22 is capped with a platen cap 23. Furthermore, a gear 24 is connected to one of the platen shafts 22. According to this printer, when printing is performed with the thermal head 10, the rotation of a conveyance motor is transmitted to the gear 24 to rotate the gear 24, so that printing is performed on recording paper while conveying the recording paper with the platen roller 20. The gear 24 may be omitted in some of the drawings to make the drawings easier to understand.

Figure 13:
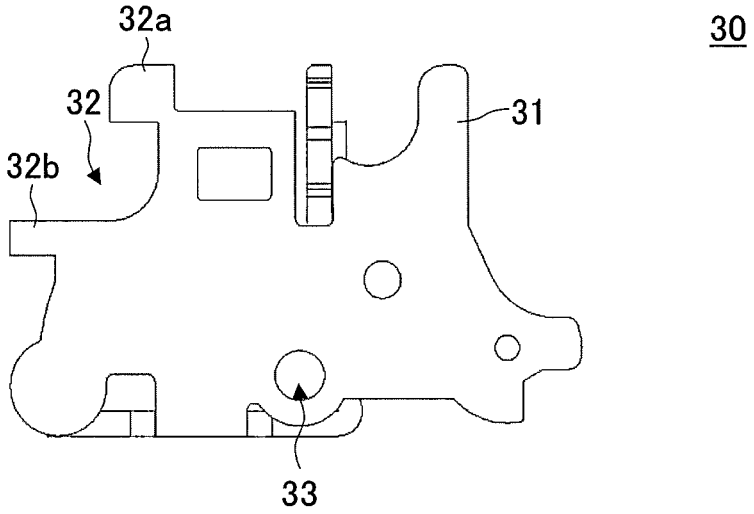
FIG. 13 is a diagram illustrating the printer according to the first embodiment.
Figure 14:
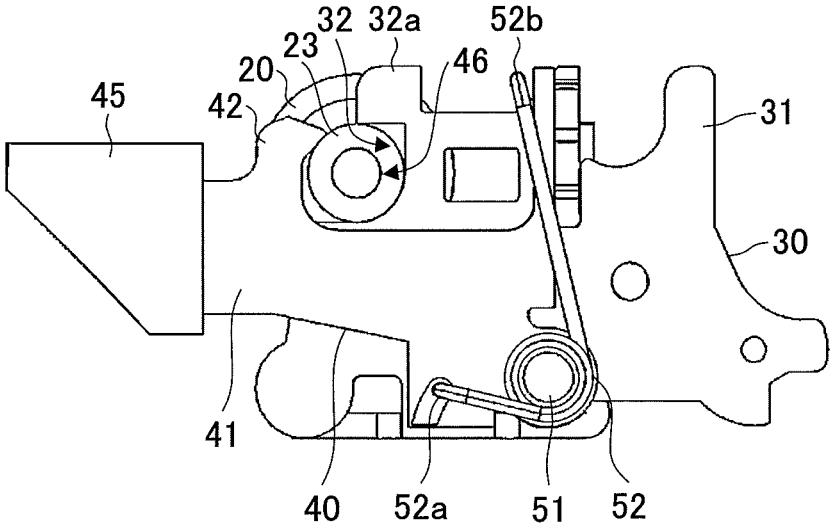
FIG. 14 is a diagram illustrating the printer according to the first embodiment.

FIG. 13 is a side view of a frame 30 of the printer, and FIG. 14 is a side view of the printer. As depicted in FIGS. 13 and 14, the frame 30 includes frame side plates 31 one at each end of the frame 30. Each frame side plate 31 is provided with a frame groove 32 for placing the platen roller 20. Furthermore, each frame side plate 31 is provided with an opening hole 33 for inserting a below-described pivot shaft 51.

Figure 15:
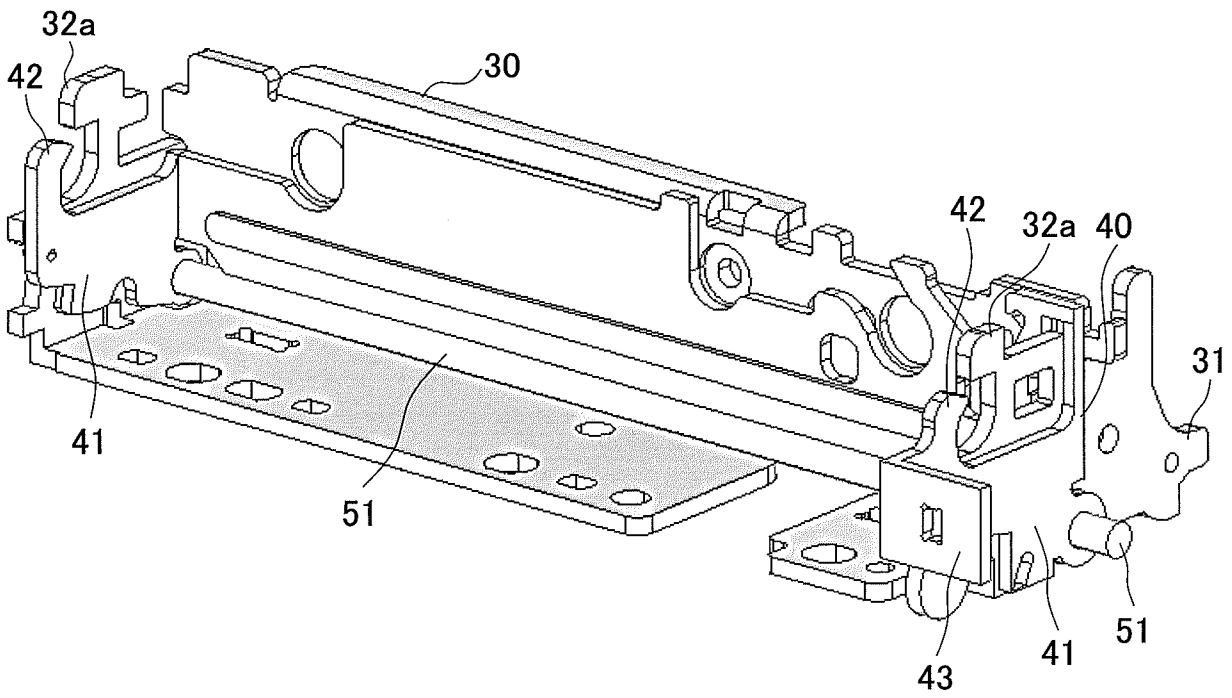
FIG. 15 is a diagram illustrating the printer according to the first embodiment.
Figure 16:
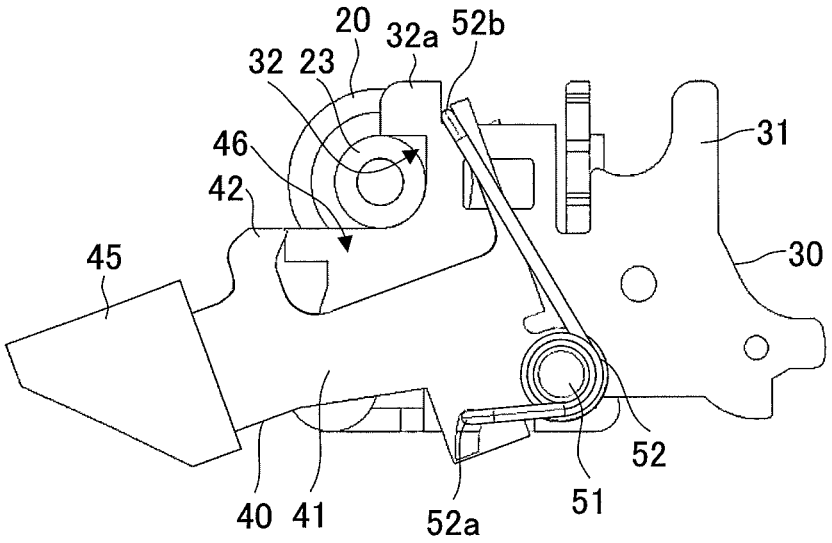
FIG. 16 is a diagram illustrating the printer according to the first embodiment.

FIG. 15 is a perspective view of a release lever 40 of the printer, and FIG. 16 is a side view of the printer. As depicted in FIGS. 15 and 16, the release lever 40 includes lever side plates 41 one at each end of the release lever 40. Each lever side plate 41 is provided with a lever groove 46 for placing the platen roller 20. The release lever 40 is so connected to the frame 30 as to be pivotable about the pivot shaft 51. As depicted in FIG. 16, it is possible to pivot the release lever 40 about the pivot shaft 51 by depressing a lever cap 45 capping a lever operation part 43. Furthermore, the release lever 40 is provided with opening holes for inserting the pivot shaft 51.

As depicted in FIGS. 14 and 16, a torsion coil spring 52 is provided around the pivot shaft 51. The torsion coil spring 52 has one end 52*a* connected to the frame 30 and another end 52*b* connected to the release lever 40. Accordingly, when the lever cap 45 of the release lever 40 is depressed, the release lever 40 pivots about the pivot shaft 51, and when a force that keeps the lever cap 45 depressed disappears, the release lever 40 is returned to its original state by the restoring force of the torsion coil spring 52.

Furthermore, as depicted in FIG. 10, coil springs 60 are placed between the thermal head 10 and the frame 30. The thermal head 10 is pressed toward the platen roller 20 by the restoring forces of the coil springs 60.

According to the printer of this embodiment, the platen roller 20 is placed on the frame 30 with the platen caps 23 being supported by support parts 42 of the lever side plates 41 of the release lever 40 while being placed in the frame grooves 32 provided in the frame side plates 31 of the frame 30.

As depicted in, for example, FIG. 13, each frame groove 32 is formed in a substantial U shape between an upper support part 32*a* and a lower support part 32*b* opposite the support part 32*a* in each frame side plate 31. Each frame groove 32 is open in a direction in which the restoring forces of the coil springs 60 act, and the platen caps 23 are placed in the frame grooves 32 between the support parts 32*a* and the support parts 32*b*.

Furthermore, as depicted in, for example, FIG. 10, the support parts 42 of the lever side plates 41 of the release lever 40 support the platen caps 23 on the side opposite to the thermal head 10 side of the platen caps 23. That is, the platen caps 23 are supported by the support parts 42 against the restoring forces of the coil springs 60.

According to this embodiment, the platen caps 23 are supported by the support parts 32*a* and 32*b* in the frame grooves 32 with respect to directions perpendicular to the direction in which the restoring forces of the coil springs 60 act. Furthermore, the platen caps 23 are supported by the support parts 42 of the release lever 40 with respect to the direction in which the restoring forces of the coil springs 60 act. As a result, the platen roller 20 can be placed at a predetermined position without coming off the frame grooves 32.

According to the printer of this embodiment, as depicted in FIG. 16, the lever cap 45 is depressed to pivot the release lever 40 about the pivot shaft 51, so that the support parts 42 of the lever side plates 41 move so as to unblock the frame grooves 32 in the direction in which the restoring forces of the coil springs 60 act. That is, the pivot of the release lever 40 about the pivot shaft 51 moves the support parts 42 of the lever side plates 41, which have supported the platen caps 23 with respect to the direction in which the restoring forces of the coil springs 60 act, so as to allow the platen caps 23 held between the frame 30 and the release lever 40 to move out of the frame grooves 32 in the direction in which the restoring forces of the coil springs 60 act. Therefore, the platen roller 20 is pressed by the restoring forces of the coil springs 60 and can be easily removed from the frame grooves 32.

[Second Embodiment]

Next, a second embodiment is described. According to this embodiment, a release lever slides relative to a frame. A printer according to this embodiment is described with reference to FIGS. 17 through 21.

Figure 17:
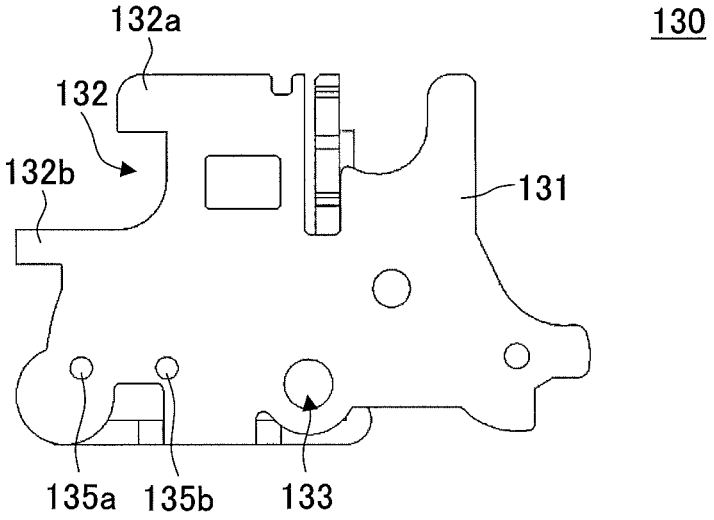
FIG. 17 is a diagram illustrating a printer according to a second embodiment.
Figure 18:
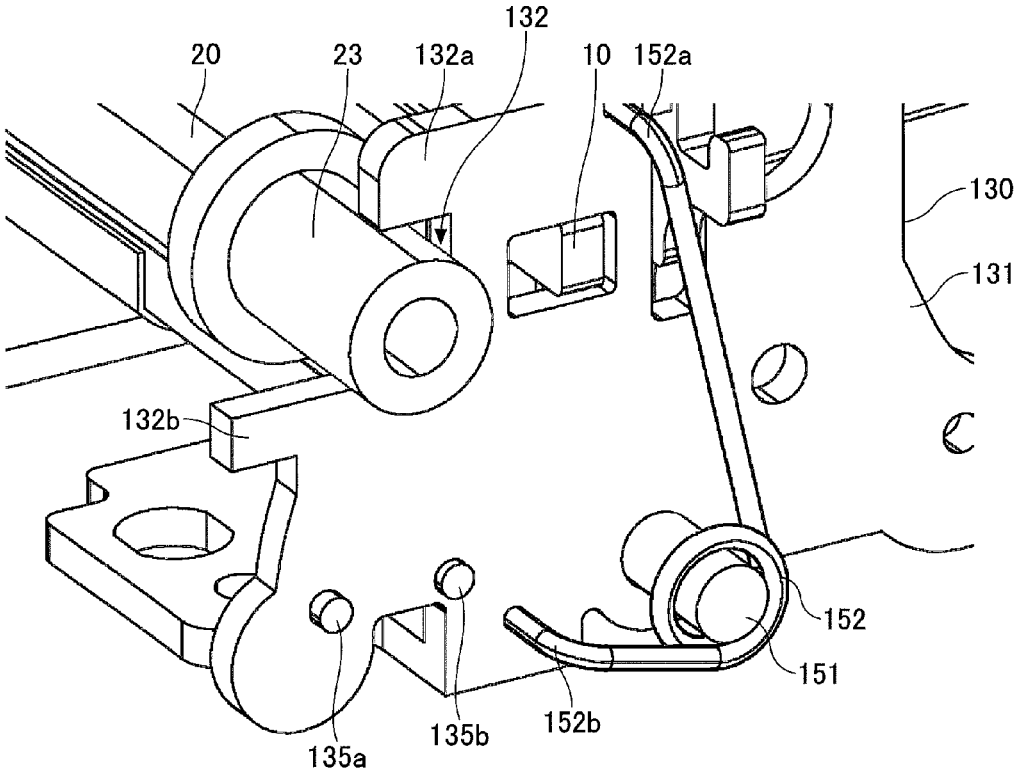
FIG. 18 is a diagram illustrating the printer according to the second embodiment.

A printer according to this embodiment includes a frame 130 and a release lever 140. The frame 130 may have the same structure as the frame 30 of the first embodiment except for frame side plates 131. The frame side plates 131 are provided one at each end of the frame 130. As depicted in FIGS. 17 and 18, each frame side plate 131 is provided with a frame groove 132 for placing the platen roller 20. Furthermore, one of the frame side plates 131 is provided with an opening hole 133 for inserting a below-described spring projection 151. Furthermore, at least one of the frame side plates 131 is provided with two projections 135*a* and 135*b*.

Figure 19:
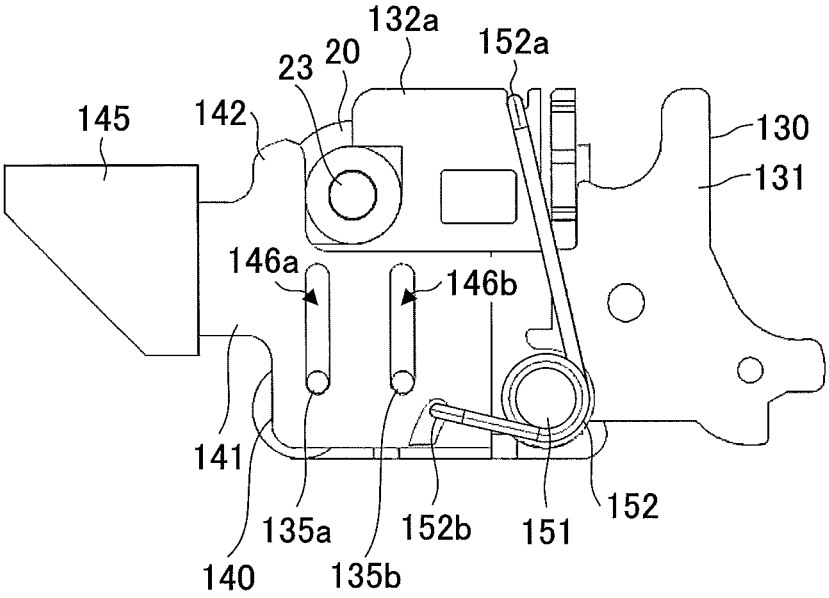
FIG. 19 is a diagram illustrating the printer according to the second embodiment.
Figure 20:
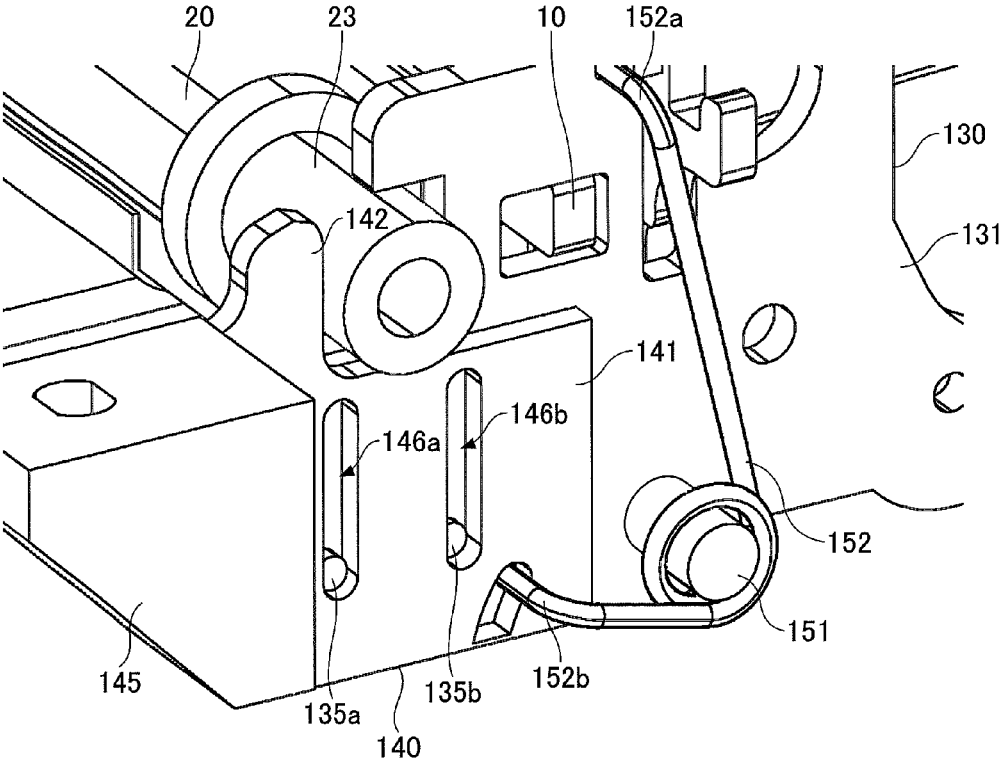
FIG. 20 is a diagram illustrating the printer according to the second embodiment.

The release lever 140 may have the same structure as the release lever 40 of the first embodiment except for lever side plates 141. The lever side plates 141 are provided one at each end of the release lever 140. As depicted in FIGS. 19 and 20, each lever side plate 141 includes a support part 142 for supporting the platen roller 20. Furthermore, the lever side plates 141 are provided with elongated openings 146*a* and 146*b* that correspond to the two projections 135*a* and 135*b* on the frame side plates 131.

According to this embodiment, the projection 135*a* of the frame 130 is placed in the opening 146*a* of the release lever 140 to be freely movable inside the opening 146*a*. Likewise, the projection 135*b* of the frame 130 is placed in the opening 146*b* of the release lever 140 to be freely movable inside the openings 146*b*.

Figure 21:
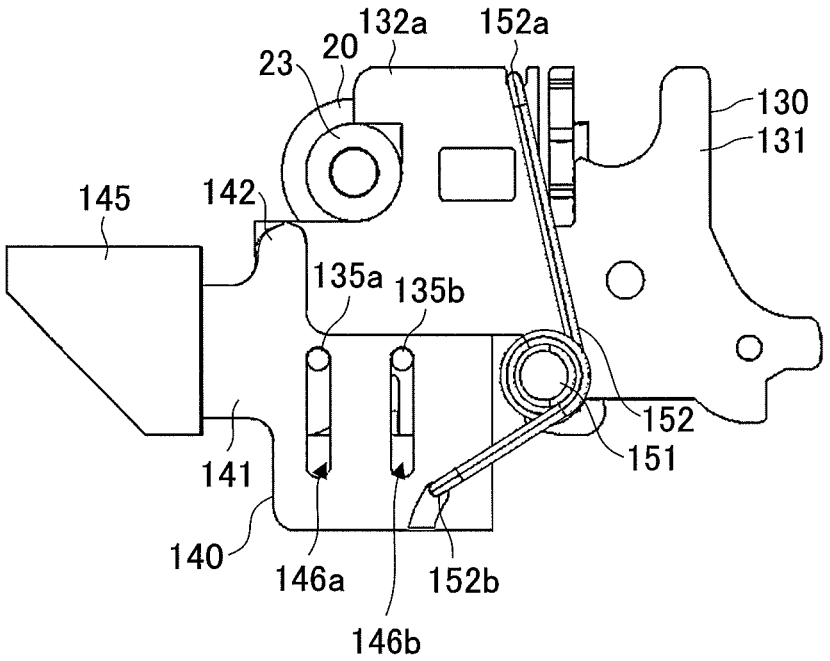
FIG. 21 is a diagram illustrating the printer according to the second embodiment.

Thus, according to the printer of this embodiment, it is possible to slide the release lever 140 in vertical directions in, for example, FIGS. 19 and 21, relative to the frame 130.

According to this embodiment, the same coil springs as the coil springs 60 of the first embodiment are provided between the thermal head 10 and the frame 130, so that the thermal head 10 is pressed toward the platen roller 20 by the restoring forces of the coil springs. Preferably, the release lever 140 slides in directions perpendicular to a direction in which the restoring forces of the coil springs act. The release lever 140 is slid by depressing a lever cap 145 capping a lever operation part of the release lever 140.

Furthermore, the spring projection 151 is provided in the opening hole 133 provided in one of the frame side plates 131, and a torsion coil spring 152 is provided with the spring projection 151 being inserted in a central portion of the torsion coil spring 152. The torsion coil spring 152 has one end 152*a* connected to the frame 130 and another end 152*b* connected to the release lever 140. Accordingly, when the lever cap 145 of the release lever 140 is depressed, the release lever 140 slides to move downward, and when a force that keeps the lever cap 145 depressed disappears, the release lever 140 is slid upward to return to its original state by the restoring force of the torsion coil spring 152.

According to the printer of this embodiment, the platen roller 20 is rotatably placed at a predetermined position with the platen caps 23 being supported by the support parts 142 of the lever side plates 141 of the release lever 140 while being placed in the frame grooves 132 provided in the frame side plates 131 of the frame 130.

As depicted in, for example, FIG. 17, each frame groove 132 is formed in a substantial U shape between an upper support part 132*a* and a lower support part 132*b* opposite the support part 132*a* in each frame side plate 131. Each frame groove 132 is open in the direction in which the restoring forces of the coil springs act, and the platen caps 23 are placed in the frame grooves 132 between the support parts 132*a* and the support parts 132*b*.

Furthermore, as depicted in, for example, FIG. 20, the support parts 142 of the lever side plates 141 of the release lever 140 support the platen caps 23 on the side opposite to the thermal head 10 side of the platen caps 23. That is, the platen caps 23 are supported by the support parts 142 against the restoring forces of the coil springs.

According to this embodiment, the platen caps 23 are supported by the support parts 132*a* and 132*b* in the frame grooves 132 with respect to directions perpendicular to the direction in which the restoring forces of the coil springs act. Furthermore, the platen caps 23 are supported by the support parts 142 of the release lever 140 with respect to the direction in which the restoring forces of the coil springs act. As a result, the platen roller 20 can be placed at a predetermined position without coming off the frame grooves 132.

According to the printer of this embodiment, as depicted in FIG. 21, the lever cap 145 is depressed to slide the release lever 140 relative to the frame 130 to unblock the frame grooves 132 in the direction in which the restoring forces of the coil springs act. That is, a slide of the release lever 140 moves the support parts 142, which have supported the platen caps 23 with respect to the direction in which the restoring forces of the coil springs act, so as to allow the platen caps 23 held between the frame 130 and the release lever 140 to move out of the frame grooves 132 in the direction in which the restoring forces of the coil springs act. Therefore, the platen roller 20 is pressed by the restoring forces of the coil springs and can be easily removed from the frame grooves 132.

In other respects than those described above, the second embodiment may be the same as the first embodiment.

[Third Embodiment]

Figure 22:
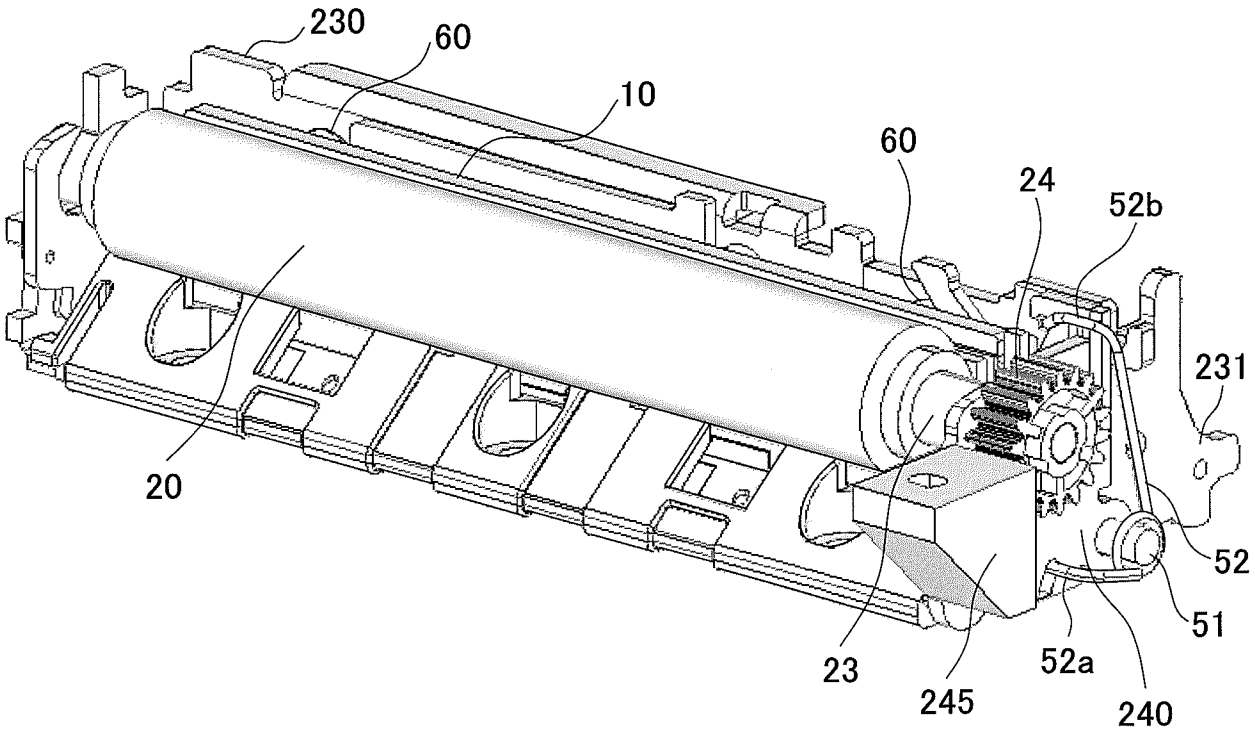
FIG. 22 is a perspective view of a printer according to a third embodiment.

Next, a printer according to a third embodiment is described with reference to FIGS. 22 through 27. FIG. 22 is a perspective view of a printer according to this embodiment. As depicted in FIG. 22, a printer according to this embodiment includes the thermal head 10 and the platen roller 20, and performs printing on recording paper with the thermal head 10 while rotating the platen roller 20 to convey the recording paper held between the thermal head 10 and the platen roller 20.

Figure 23:
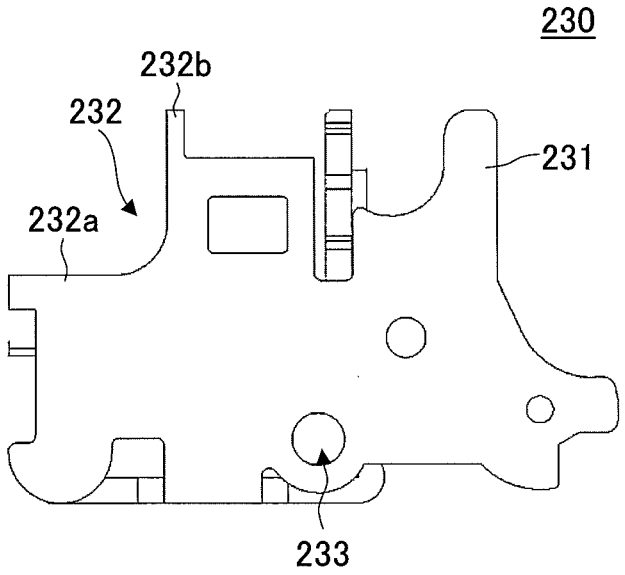
FIG. 23 is a diagram illustrating the printer according to the third embodiment.

The printer according to this embodiment includes a frame 230 and a release lever 240. FIG. 23 is a side view of the frame 230. The frame 230 includes frame side plates 231 one at each end of the frame 230. As depicted in FIG. 23, each frame side plate 231 is provided with a frame groove 232 for placing the platen roller 20. Furthermore, each frame side plate 231 is provided with an opening hole 233 for inserting the pivot shaft 51.

Figure 24:
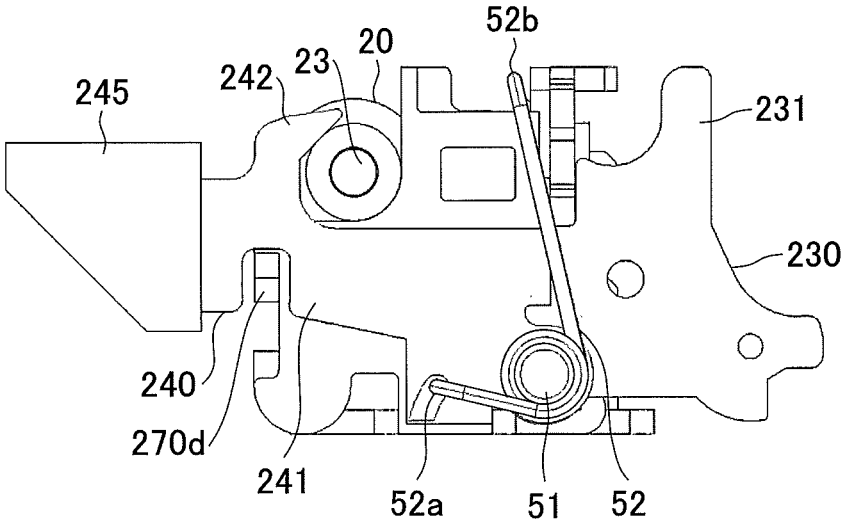
FIG. 24 is a diagram illustrating the printer according to the third embodiment.
Figure 25:
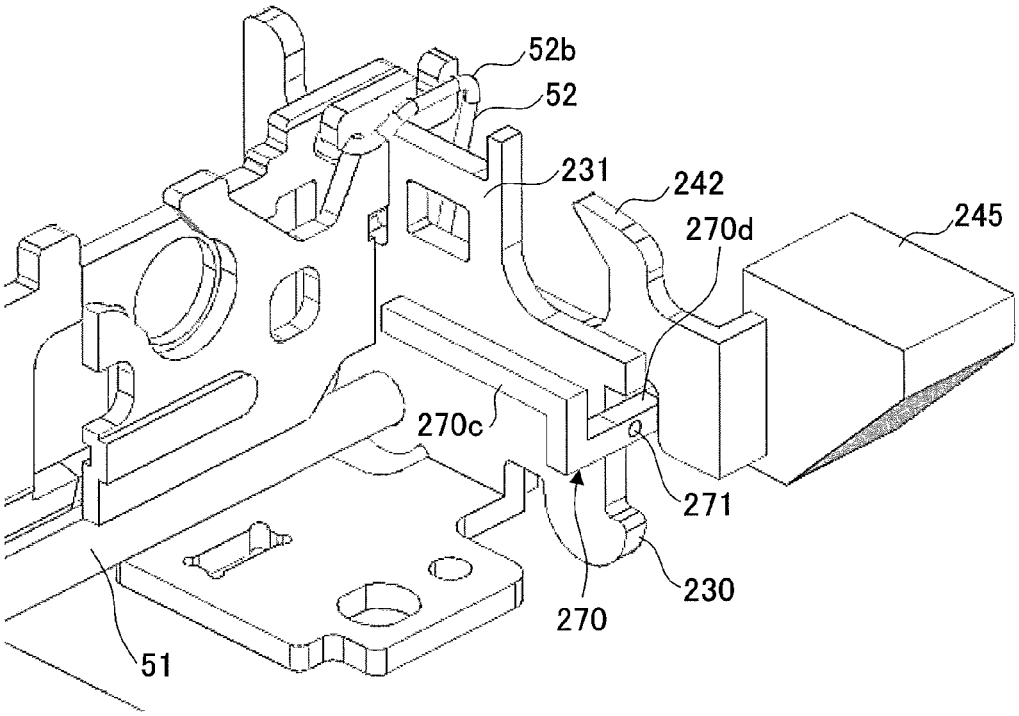
FIG. 25 is a diagram illustrating the printer according to the third embodiment.
Figure 26:
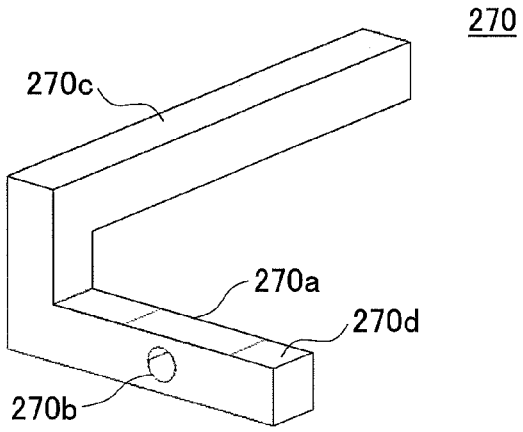
FIG. 26 is a diagram illustrating the printer according to the third embodiment.
Figure 27:
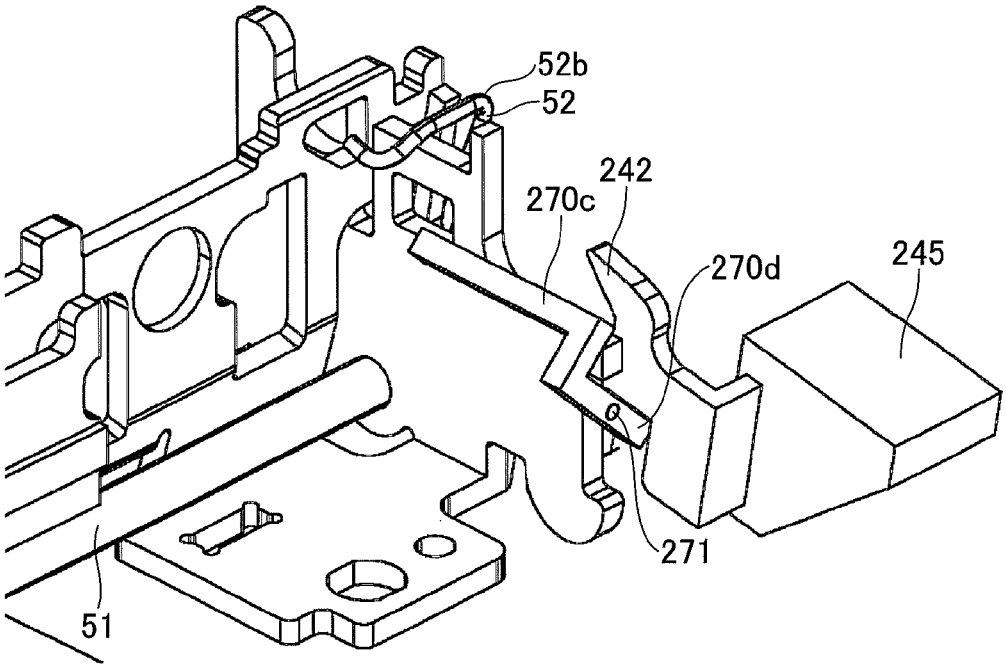
FIG. 27 is a diagram illustrating the printer according to the third embodiment.

FIG. 24 is a side view of the printer. FIG. 25 is an enlarged view of part of the printer, depicting a state before the release lever 240 is pivoted. FIG. 26 is a diagram depicting a platen roller lifting member 270 that pushes up the platen roller 20. FIG. 27 is an enlarged view of part of the printer, depicting a state after the release lever 240 is pivoted.

The release lever 240 includes lever side plates 241 one at each end of the release lever 240. As depicted in FIG. 24, each lever side plate 241 includes a support part 242 for supporting the platen roller 20. The release lever 240 is so connected to the frame 230 as to be pivotable about the pivot shaft 51. As depicted in FIG. 27, it is possible to pivot the release lever 240 about the pivot shaft 51 by depressing a lever cap 245 capping a lever operation part of the release lever 240. The release lever 240 is provided with opening holes for inserting the pivot shaft 51.

The torsion coil spring 52 is provided around the pivot shaft 51. The torsion coil spring 52 has the end 52*a* connected to the frame 230 and the end 52*b* connected to the release lever 240. Accordingly, when the lever cap 245 of the release lever 240 is depressed, the release lever 240 pivots about the pivot shaft 51, and when a force that keeps the lever cap 245 depressed disappears, the release lever 240 is returned to its original state by the restoring force of the torsion coil spring 52.

Furthermore, as depicted in FIG. 22, the coil springs 60 are provided between the thermal head 10 and the frame 230. The thermal head 10 is pressed toward the platen roller 20 by the restoring forces of the coil springs 60.

According to the printer of this embodiment, the platen roller 20 is rotatably placed at a predetermined position with the platen caps 23 being supported by the support parts 242 of the lever side plates 241 while being placed in the frame grooves 232 provided in the frame side plates 231.

Each frame groove 232 is defined by a support part 232*a* and a support part 232*b* of each frame side plate 231, which support each platen cap 23 on its bottom side and thermal head 10 side, respectively. The frame grooves 232 are open upward and in a direction in which the restoring forces of the coil springs 60 act, and the platen caps 23 are supported by the support parts 232*a* and 232*b*.

Furthermore, as depicted in FIGS. 22 and 24, the support parts 242 of the lever side plates 241 support the platen caps 23 on the side opposite to the thermal head 10 side of the platen caps 23. That is, the platen caps 23 are supported by the support parts 242 against the restoring forces of the coil springs 60.

According to this embodiment, the platen caps 23 are supported by the support parts 232*a* and 232*b* in the frame grooves 232, and are supported by the support parts 242 with respect to the direction in which the restoring forces of the coil springs 60 act. As a result, the platen roller 20 can be placed at a predetermined position without coming off the frame grooves 232.

Furthermore, as depicted in FIGS. 25 through 27, the platen roller lifting member 270 that pushes up the platen roller 20 is so connected to the frame 230 as to be pivotable about a pivot shaft 271 provided on the frame 230. The platen roller lifting member 270 includes a connection part 270*a* in which a hole 270*b* is formed, and the connection part 270*a* is pivotably connected to the pivot shaft 271 at the hole 270*b*. The platen roller lifting member 270 further includes a contact part 270*c* that extends from one end of the connection part 270*a* to be parallel to the frame side plates 231. The contact part 270*c* has, for example, an L shape.

As depicted in FIG. 27, by depressing the lever cap 245, the support parts 242 of the lever side plates 241 move to unblock the frame grooves 232 in the direction in which the restoring forces of the coil springs 60 act. That is, the platen caps 23 (not depicted in FIG. 27) held between the frame 230 and the release lever 240 are allowed to move out of the frame grooves 232 in the direction in which the restoring forces of the coil springs 60 act. Furthermore, with the downward movement of the lever cap 245, another end 270*d* of the platen roller lifting member 270 is depressed by the release lever 240 to pivot the platen roller lifting member 270 (clockwise in FIG. 27) about the pivot shaft 271, so that the contact part 270*c* contacts and pushes up the platen roller 20 (not depicted in FIG. 27). As a result, it is possible to easily detach the platen roller 20.

In other respects than those described above, the third embodiment may be the same as the first embodiment.

[Fourth Embodiment]

Next, a fourth embodiment is described. According to this embodiment, a release lever slides relative to a frame. A printer according to this embodiment is described with reference to FIGS. 28 through 34.

Figure 28:
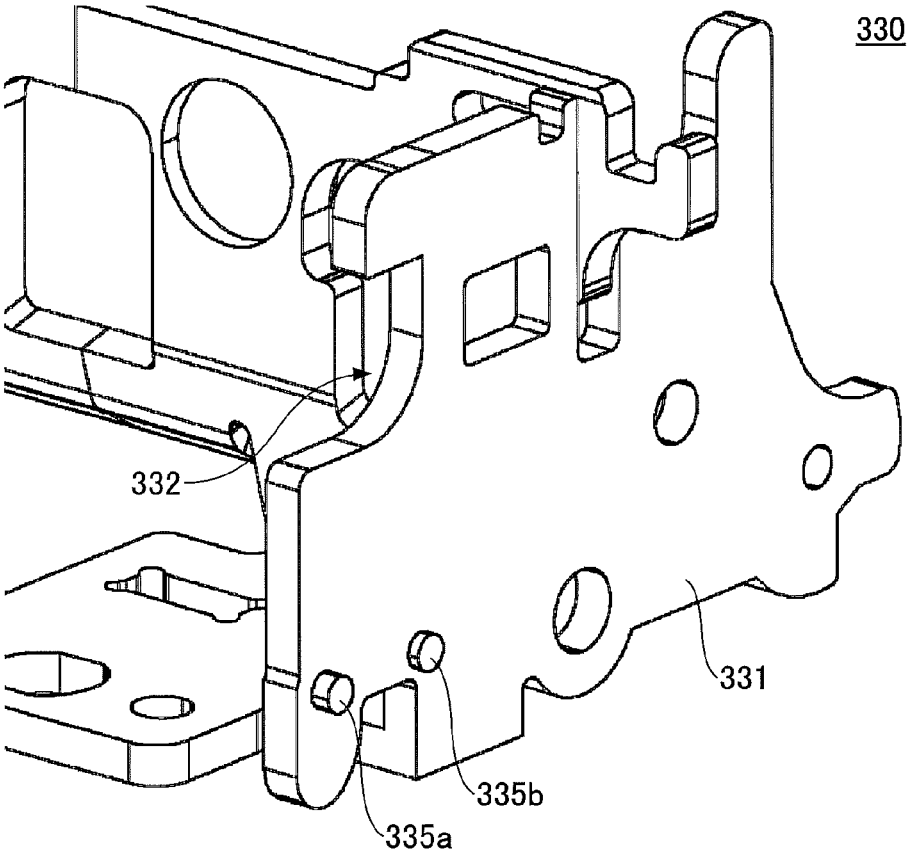
FIG. 28 is a diagram illustrating a printer according to a fourth embodiment.
Figure 29:
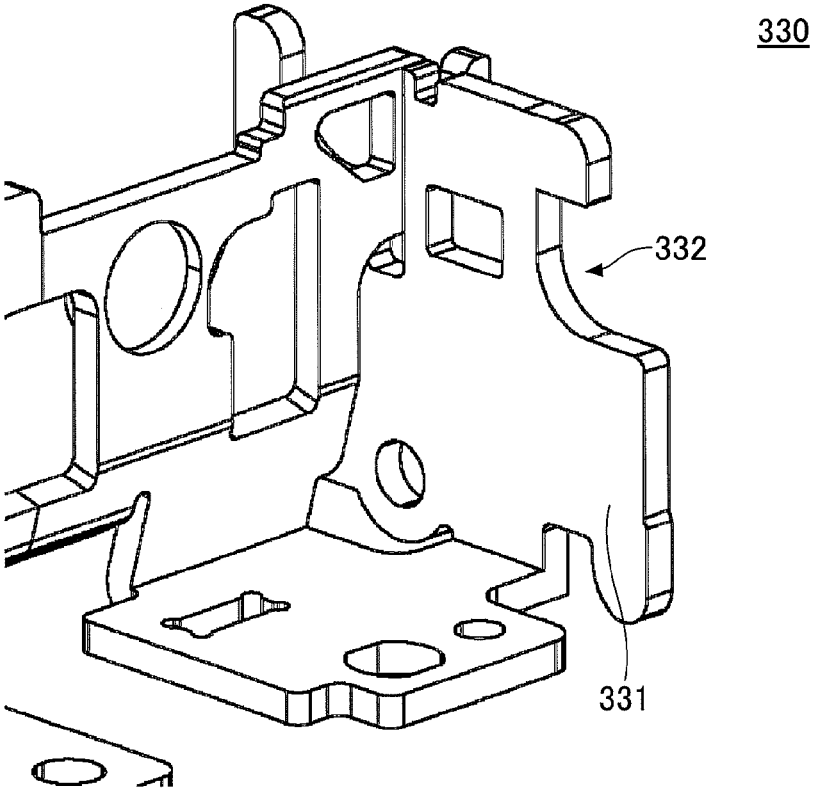
FIG. 29 is a diagram illustrating the printer according to the fourth embodiment.

A printer according to this embodiment includes a frame 330 and a release lever 340. The frame 330 may have the same structure as the frame 130 of the second embodiment except for frame side plates 331. FIGS. 28 and 29 are exterior and interior perspective views of part of the printer, respectively. The frame side plates 331 are provided one at each end of the frame 330. As depicted in FIGS. 28 and 29, each frame side plate 331 is provided with a frame groove 332 for placing the platen roller 20. Furthermore, at least one of the frame side plates 331 is provided with two projections 335*a* and 335*b*.

Figure 30:
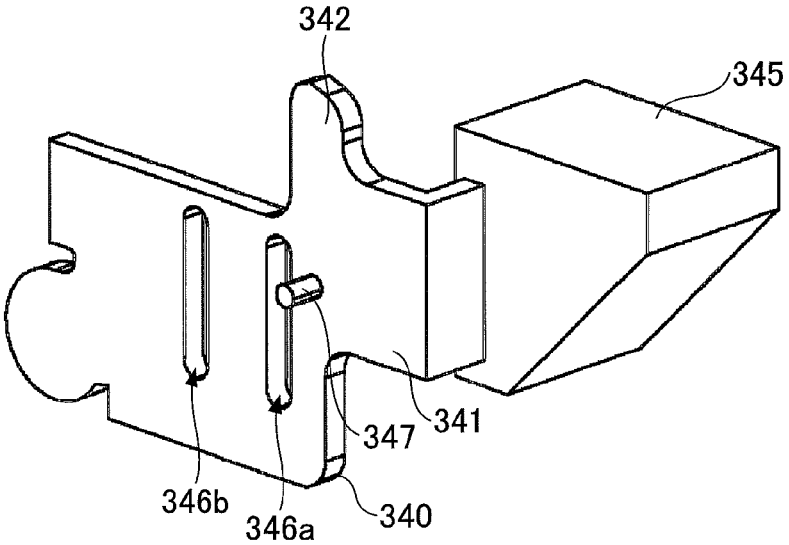
FIG. 30 is a diagram illustrating the printer according to the fourth embodiment.

The release lever 340 may have the same structure as the release lever 140 of the second embodiment except for lever side plates 341. FIG. 30 is a diagram depicting part of the release lever 340. The lever side plates 341 are provided one at each end of the release lever 340. As depicted in FIG. 30, each lever side plate 341 includes a support part 342 for supporting the platen roller 20. Furthermore, at least one of the lever side plates 341 is provided with elongated openings 346*a* and 346*b* that correspond to the two projections 335*a* and 335*b* on the at least one of the frame side plates 331.

According to the printer of this embodiment, the platen roller 20 is rotatably placed at a predetermined position with the platen caps 23 being supported by the support parts 342 of the lever side plates 341 while being placed in the frame grooves 332 of the frame side plates 331.

According to this embodiment, the projection 335*a* of the frame 330 is placed in the opening 346*a* of the release lever 340 to be freely movable inside the opening 346*a*. Likewise, the projection 335*b* of the frame 330 is placed in the opening 346*b* of the release lever 340 to be freely movable inside the opening 346*b*.

Figure 31:
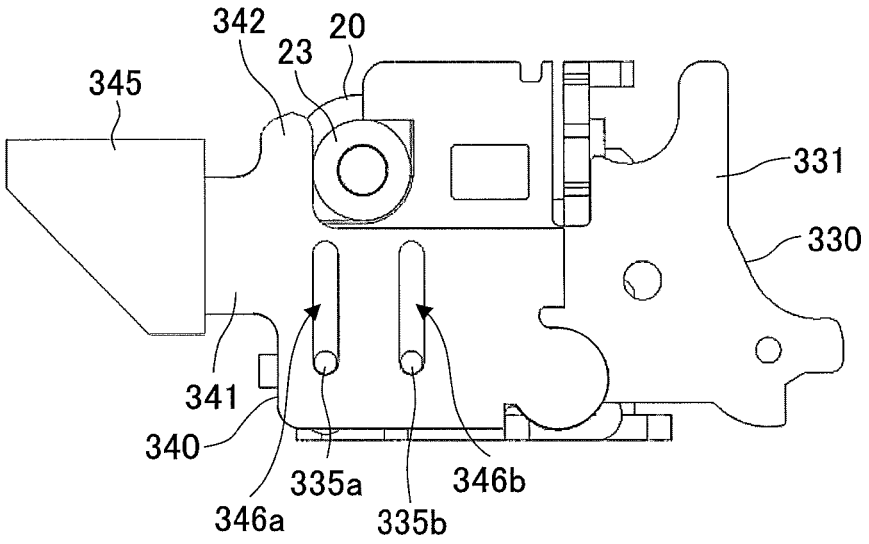
FIG. 31 is a diagram illustrating the printer according to the fourth embodiment.

According to the printer of this embodiment, it is possible to slide the release lever 340 in vertical directions in, for example, FIG. 31, relative to the frame 330. FIG. 31 is a side view of the printer. According to this embodiment, the same as in the second embodiment, coil springs are provided between the thermal head 10 and the frame 330, and the thermal head 10 is pressed toward the platen roller 20 by the restoring forces of the coil springs. Preferably, the release lever 340 slides in directions perpendicular to a direction in which the restoring forces of the coil springs act. It is possible to slide the release lever 340 by depressing a lever cap 345 capping a lever operation part of the release lever 340.

Figure 32:
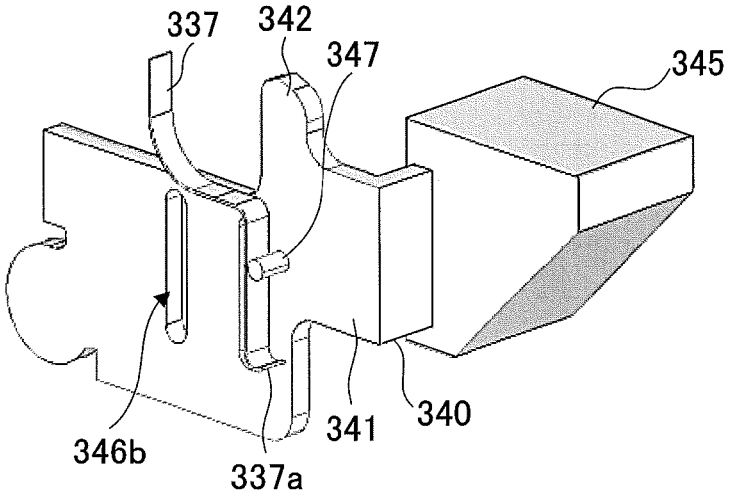
FIG. 32 is a diagram illustrating the printer according to the fourth embodiment.
Figure 33:
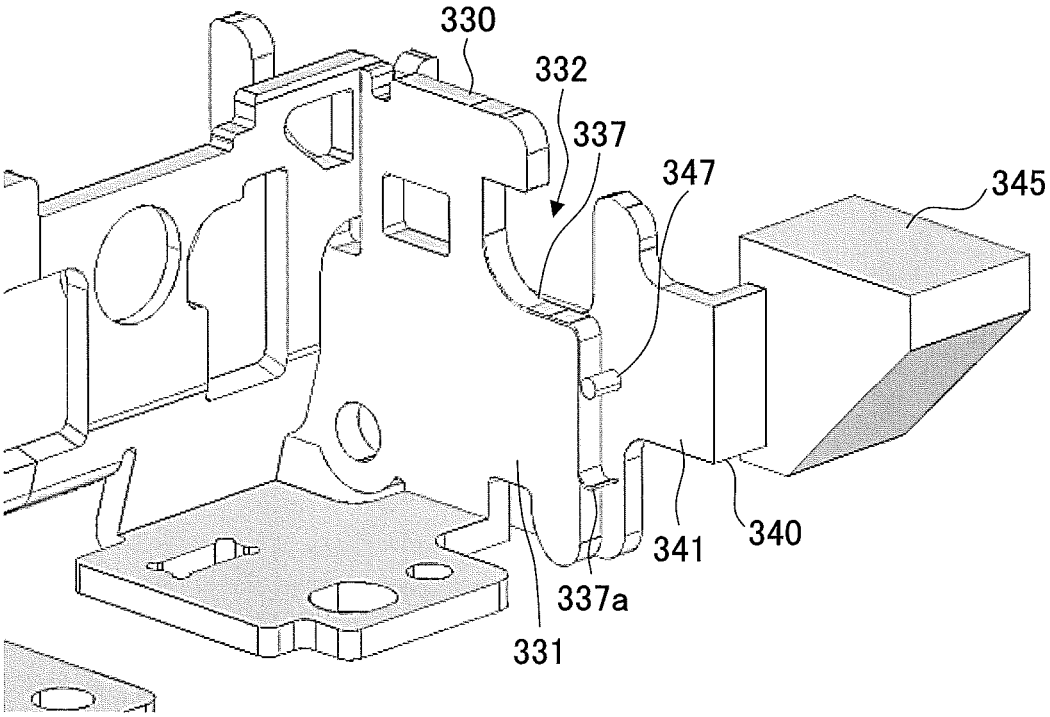
FIG. 33 is a diagram illustrating the printer according to the fourth embodiment.
Figure 34:
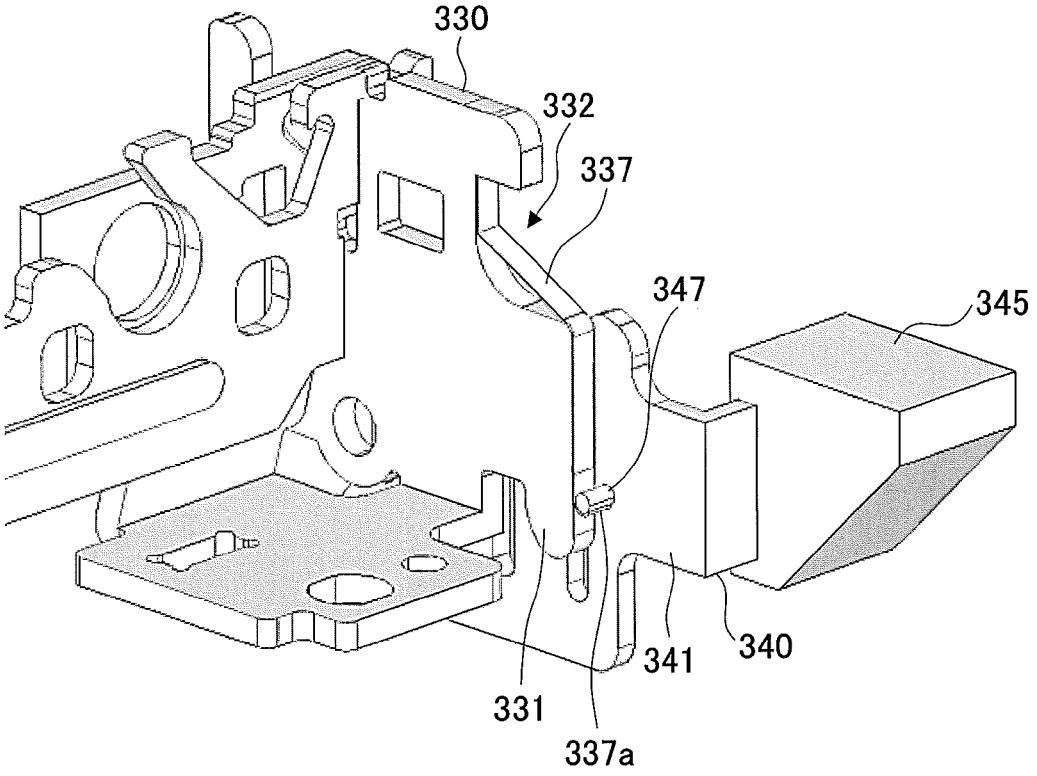
FIG. 34 is a diagram illustrating the printer according to the fourth embodiment.

According to this embodiment, a projection 347 is provided on an interior surface of at least one of the lever side plates 341 of the release lever 340. Furthermore, as depicted in, for example, FIGS. 32 through 34, a leaf spring 337 is provided on a surface of at least one of the frame side plates 331 facing away from the thermal head 10, which surface includes a surface of the frame groove 332, and an end 337*a* of the leaf spring 337 is bent. FIG. 32 is a diagram depicting part of the release lever 340 together with the leaf spring 337. FIG. 33 is a perspective view of part of the printer, depicting a state before the lever cap 345 is depressed. FIG. 34 is a perspective view of part of the printer, depicting a state after the lever cap 345 is depressed.

According to the printer of this embodiment, when the lever cap 345 is depressed in the state depicted in FIG. 33, the release lever 340 slides relative to the frame 330 to unblock the frame grooves 332 in the direction in which the restoring forces of the coil springs act.

Furthermore, with the downward movement of the lever cap 345, the projection 347 provided on the release lever 340 presses down or pulls down the end 337*a* of the leaf spring 337 to stretch the leaf spring 337. As a result, it is possible to push out the platen roller 20 placed in the frame grooves 332 with the leaf spring 337. Accordingly, it is possible to easily remove the platen roller 20 from the frame grooves 332.

In other respects than those described above, the fourth embodiment may be the same as the second embodiment.

[Fifth Embodiment]

Next, a fifth embodiment is described with reference to FIGS. 35 and 36. According to this embodiment, the release lever 40 of the printer of the first embodiment is provided with a pushing part 442 at a position that faces the support part 42 of at least one of the lever side plates 41 across one of the platen caps 23 of the platen roller 20. That is, at least one of the lever side plates 41 includes the support part 42 on one side of a lever groove 420 and the pushing part 442 on the other side of the lever groove 420.

Figure 35:
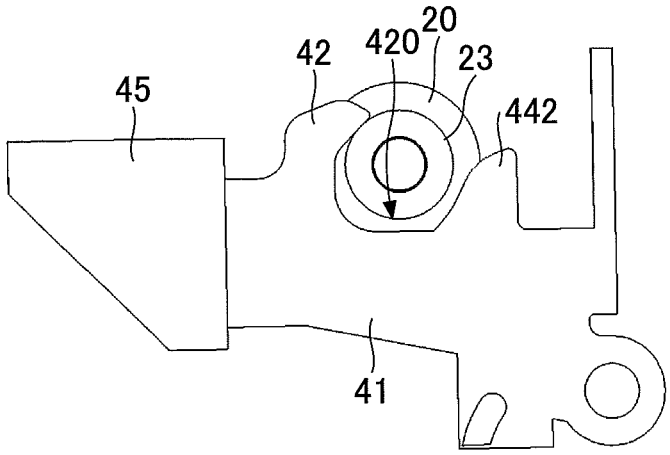
FIG. 35 is a diagram illustrating a printer according to a fifth embodiment.
Figure 36:
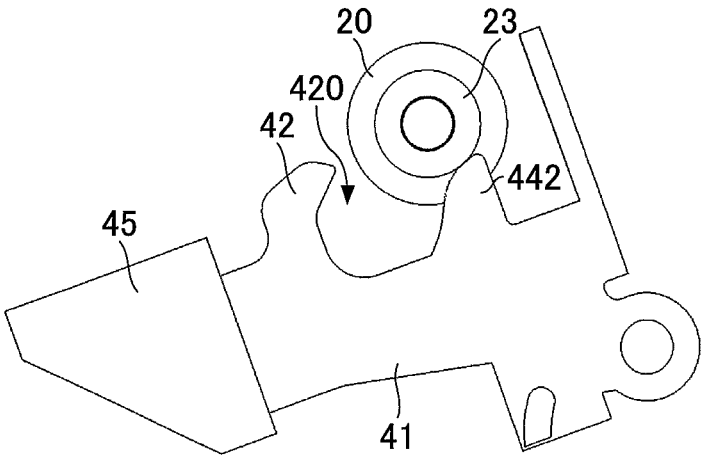
FIG. 36 is a diagram illustrating the printer according to the fifth embodiment.

FIG. 35 is a side view of the printer, depicting a state before the lever cap 45 is depressed, and FIG. 36 is a side view of the printer, depicting a state after the lever cap 45 is depressed. As depicted in FIG. 35, at least one of the platen caps 23 is provided in the lever groove 420 between the support part 42 and the pushing part 442.

When the lever cap 45 of the release lever 40 is depressed in the state of FIG. 35, the platen cap 23 is pressed by the pushing part 442 as depicted in FIG. 36, so that it is possible to detach the platen roller 20.

In other respects than those described above, the fifth embodiment may be the same as the first embodiment.

[Sixth Embodiment]

Figure 37:
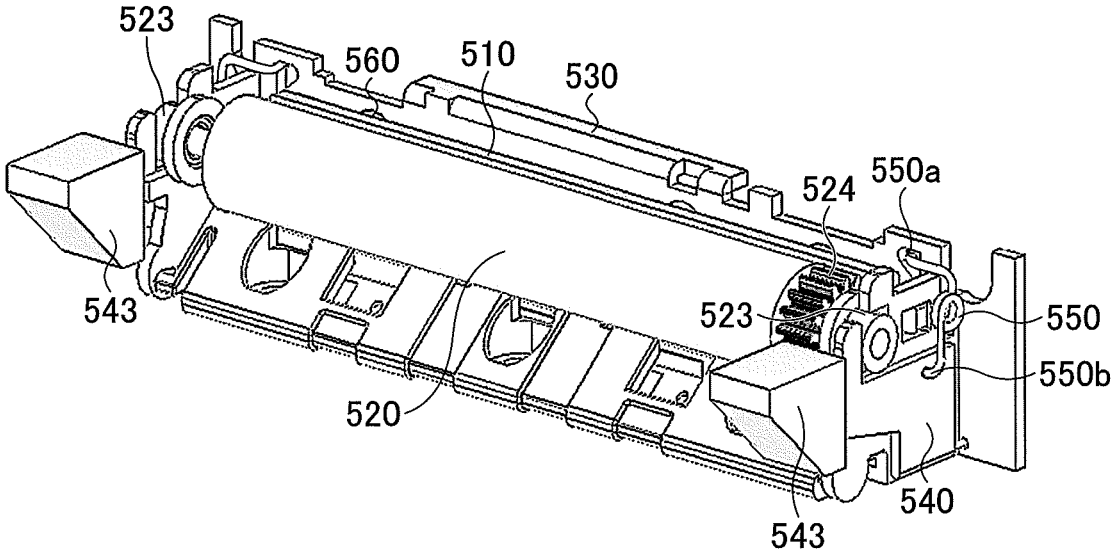
FIG. 37 is a perspective view of a printer according to a sixth embodiment.

Next, a printer according to a sixth embodiment is described with reference to FIGS. 37 through 50. As depicted in FIG. 37, a printer according to this embodiment includes a thermal head 510, which is a print head, and a platen roller 520, and performs printing on recording paper with the thermal head 510 while rotating the platen roller 520 to convey the recording paper held between the thermal head 510 and the platen roller 520.

The printer according to this embodiment includes coil springs 560 placed between the thermal head 510 and a frame 530, and the thermal head 510 is pressed toward the platen roller 520 by the restoring forces of the coil springs 560.

Figure 38:
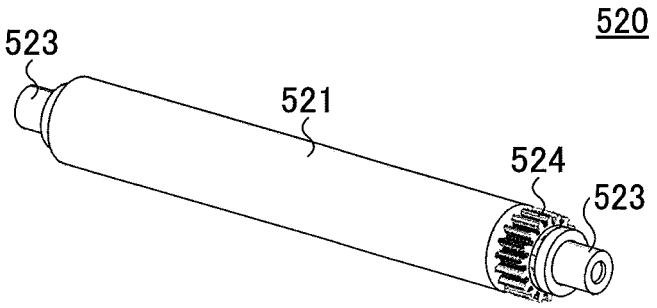
FIG. 38 is a diagram illustrating a platen roller of the printer of the sixth embodiment.
Figure 39:
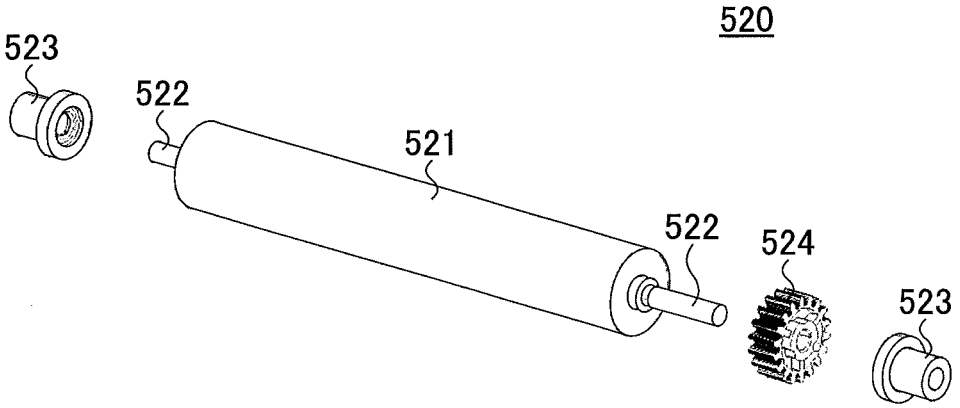
FIG. 39 is a diagram illustrating the platen roller of the printer according to the sixth embodiment.

FIG. 38 is a perspective view of the platen roller 520, and FIG. 39 is an exploded perspective view of the platen roller 520. As depicted in FIGS. 38 and 39, the platen roller 520 includes a roller 521 and platen shafts 522 one provided at each end of the roller 521, and each platen shaft 522 is capped with a platen cap 523. Furthermore, a gear 524 is connected to one of the platen shafts 522 inside one of the platen caps 523 that caps the one of the platen shafts 522.

According to the printer of this embodiment, when printing is performed with the thermal head 510, the rotation of a conveyance motor is transmitted to the gear 524 at the platen roller 520 to rotate the platen roller 520 via the gear 524, so that printing is performed on recording paper while conveying the recording paper with the platen roller 520. The gear 524 may be omitted in some of the drawings to make the drawings easier to understand.

Figure 40:
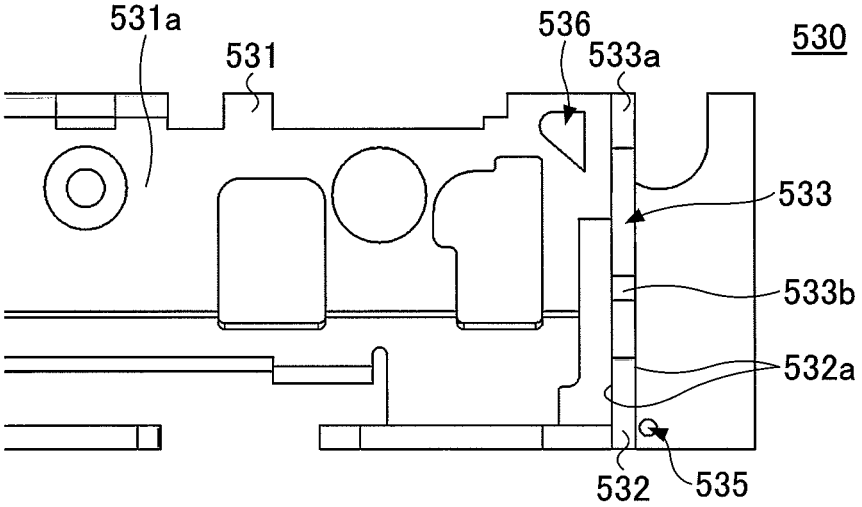
FIG. 40 is a front view of a frame of the printer according to the sixth embodiment.
Figure 41:
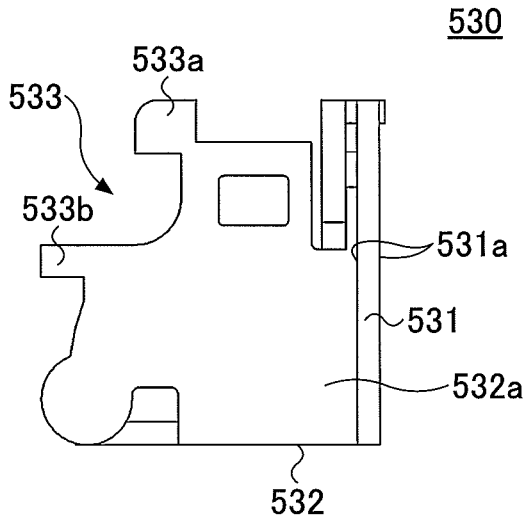
FIG. 41 is a side view of the frame of the printer according to the sixth embodiment.

FIG. 40 is a front view of the frame 530. FIG. 41 is a side view of the frame 530. As depicted in FIGS. 40 and 41, the frame 530 includes a plate-shaped frame plate 531 and frame side plates 532 one provided on each end side of the frame plate 531. Each frame side plate 532 is provided with a frame groove 533 for placing the platen roller 520. Each frame groove 533 is formed in a substantial U shape between an upper support part 533*a* and a lower support part 533*b* opposite the support part 533*a* in each frame side plate 532.

Each frame side plate 532 includes surfaces 532*a* that are substantially perpendicular to surfaces 531*a* of the frame plate 531. Furthermore, the thermal head 510 and the platen roller 520 are placed on the frame 530 so that a longitudinal direction of the thermal head 10 and an axial direction of the platen roller 520 are substantially parallel to the surfaces 531*a* of the frame plate 531. Therefore, the axial direction of the platen roller 520 is substantially perpendicular to the surfaces 532*a* of each frame side plate 532.

The frame grooves 533 are open in a direction in which the restoring forces of the coil springs 560 act. The platen caps 523 are placed between the support parts 533*a* and the support parts 533*b*.

Furthermore, as depicted in FIG. 40, circular openings 535 for inserting pivot shafts 542 of below-described release levers 540 are provided in the frame plate 531 outside the frame side plates 532 in the frame 530. Furthermore, spring holes 536 for inserting ends 550*a* of below-described torsion coil springs 550 are provided in the frame plate 531 inside the frame side plates 532.

Figure 42:
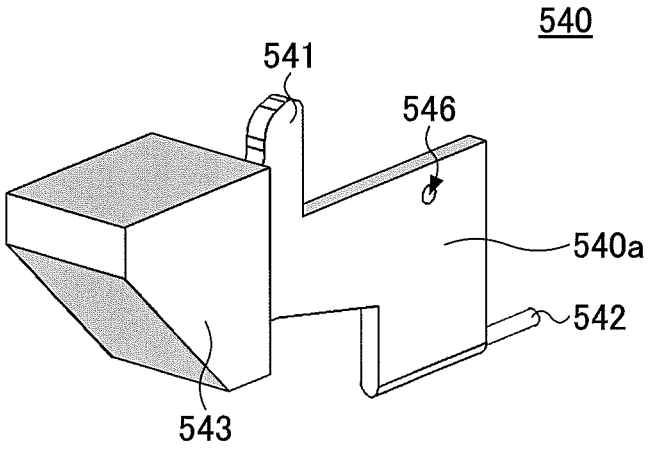
FIG. 42 is a perspective view of a release lever of the printer according to the sixth embodiment.

The release levers 540, each having a configuration as depicted in FIG. 42, are provided one outside each of the frame side plates 532 that are provided one at each end of the frame 530. Thus, according to the printer of this embodiment, the two release levers 540 in total are provided, one at each end of the frame 530, to form a pair of release levers.

Figure 43:
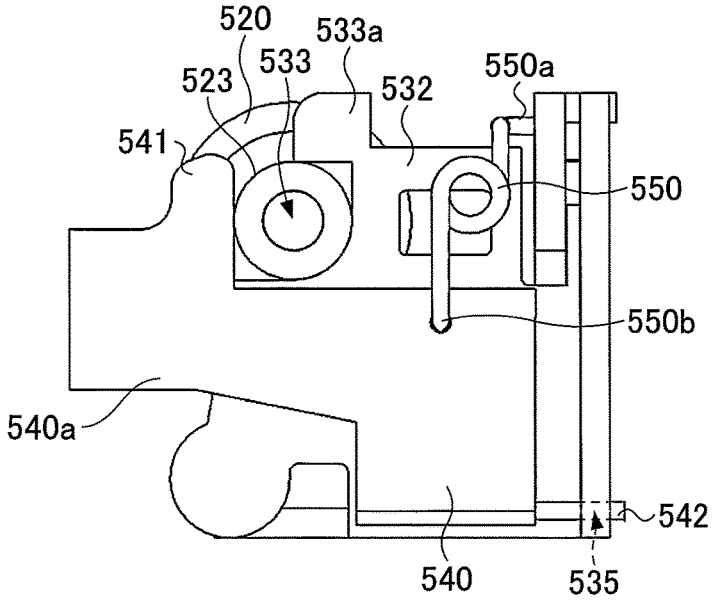
FIG. 43 is a side view of the printer according to the sixth embodiment.
Figure 44:
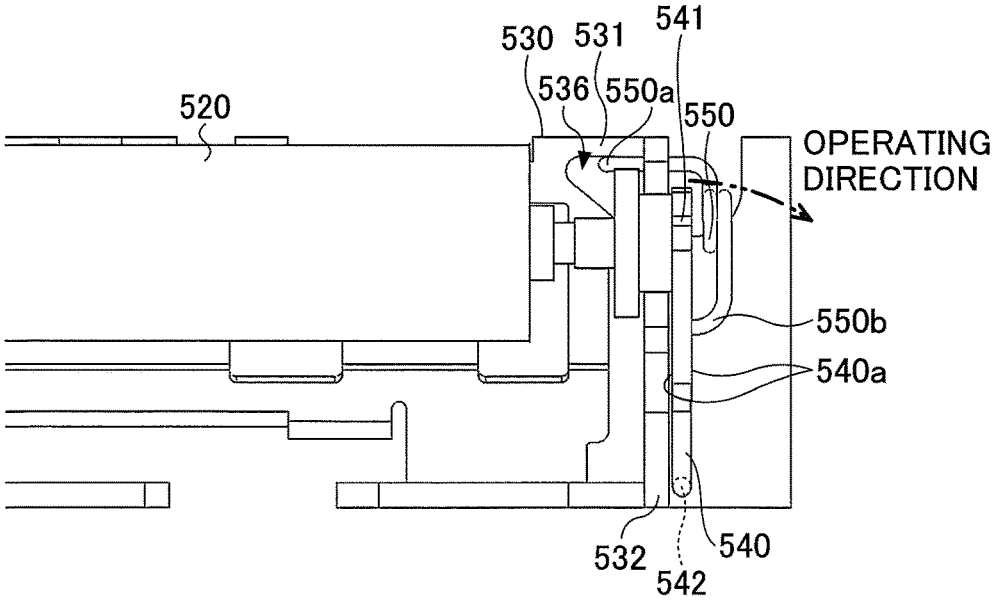
FIG. 44 is a front view of the printer according to the sixth embodiment.
Figure 45:
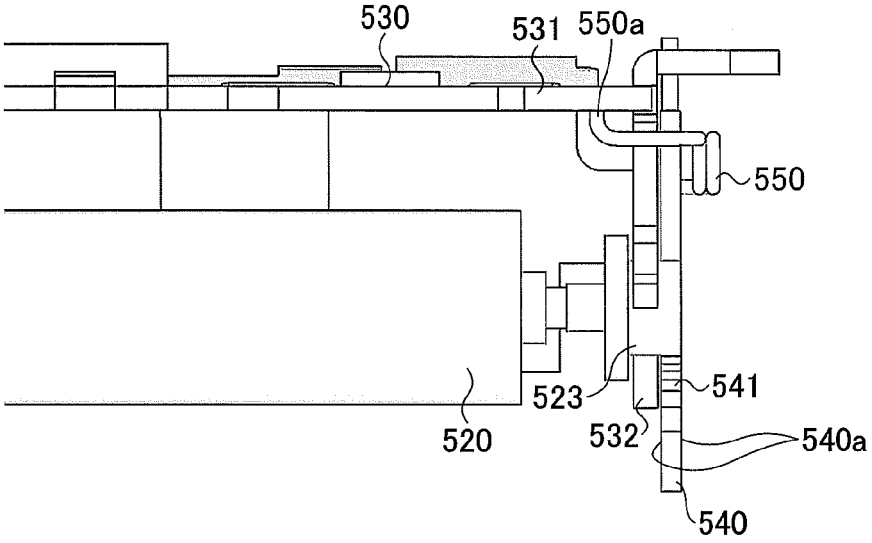
FIG. 45 is a plan view of the printer according to the sixth embodiment.

FIGS. 43, 44 and 45 are a side view, a front view, and a plan view, respectively, of the printer of this embodiment, in which the platen roller 520 is attached to the frame 530. p As depicted in FIGS. 42 and 43, each release lever 540 has a plate-shaped body, which includes a support part 541 for supporting the platen roller 520 placed on the frame 530. Furthermore, each release lever 540 includes the pivot shaft 542 provided at one end of the body and a lever cap 543 attached to the other end of the body. Accordingly, the support part 541 is formed between the pivot shaft 542 and the lever cap 543 in each release lever 540. Furthermore, the release levers 540 are provided with respective spring holes 546 into which other ends 550*b* of the torsion coil springs 550 are inserted.

According to the printer of this embodiment, the platen roller 520 is placed on the frame 530 with the platen caps 523 attached to the platen roller 520 being supported by the support parts 541 of the release levers 540 while being placed in the frame grooves 533 provided in the frame side plates 532.

As depicted in FIG. 43, the support parts 541 of the release levers 540 support the platen caps 523 on the side opposite to the thermal head 510 side of the platen caps 523. That is, the platen caps 523 are supported by the support parts 541 against the restoring forces of the coil springs 560.

According to this embodiment, the platen caps 523 are supported by the support parts 533*a* and 533*b* in the frame grooves 533 with respect to directions perpendicular to the direction in which the restoring forces of the coil springs 560 act. Furthermore, the platen caps 523 are supported by the support parts 541 of the release levers 540 with respect to the direction in which the restoring forces of the coil springs 560 act. As a result, the platen roller 520 can be placed on the frame 530 without coming off the frame grooves 533.

According to the printer of this embodiment, as depicted in FIGS. 43 through 45, the pivot shaft 542 of each release lever 540 is inserted in one of the openings 535 provided in the frame 530, and each release lever 540 is pivotable on the pivot shaft 542 in a direction away from the frame 530, which is indicated as "operating direction" by the arrow in FIG. 44. Furthermore, each torsion coil spring 550 has the end 550*a* inserted in one of the spring holes 536 provided in the frame 530 and the other end 550*b* inserted in the spring hole 546 of one of the release levers 540. The restoring forces of the torsion coil springs 550 are exerted in directions to press the release levers 540 toward the frame side plates 532. That is, the restoring forces of the torsion coil springs 550 are exerted in directions to draw the release levers 540 toward the frame side plates 532. When the release levers 540 are not pivoted, surfaces 540*a* of the release levers 540 are substantially parallel to the frame side plates 532.

Figure 46:
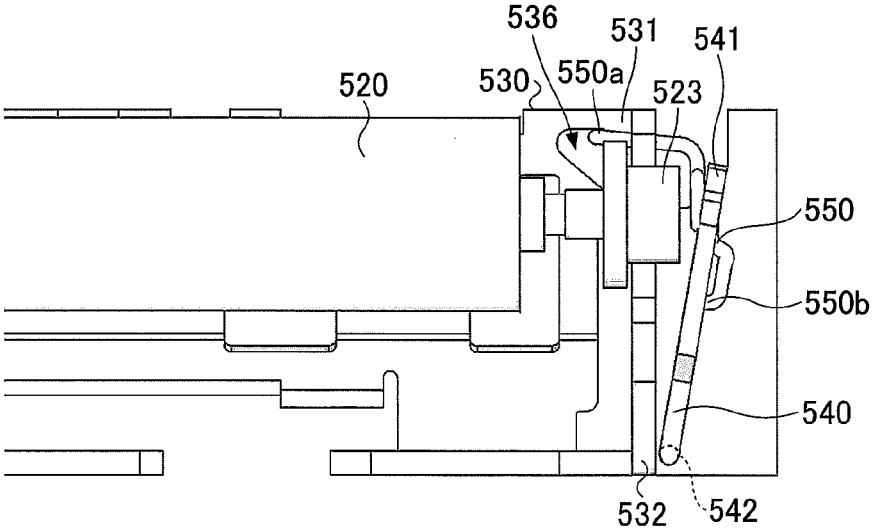
FIG. 46 is a front view of the printer according to the sixth embodiment.
Figure 47:
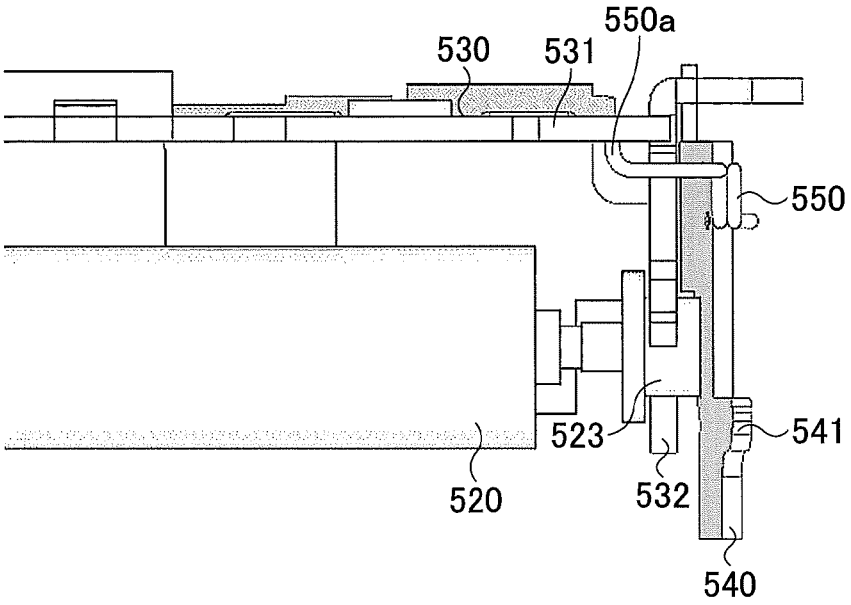
FIG. 47 is a plan view of the printer according to the sixth embodiment.
Figure 48:
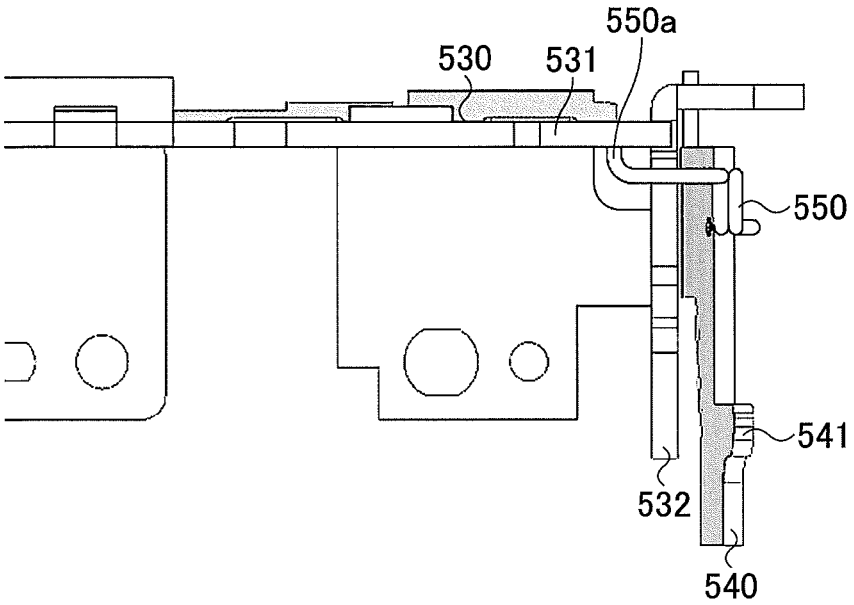
FIG. 48 is a plan view of the printer according to the sixth embodiment.
Figure 49:
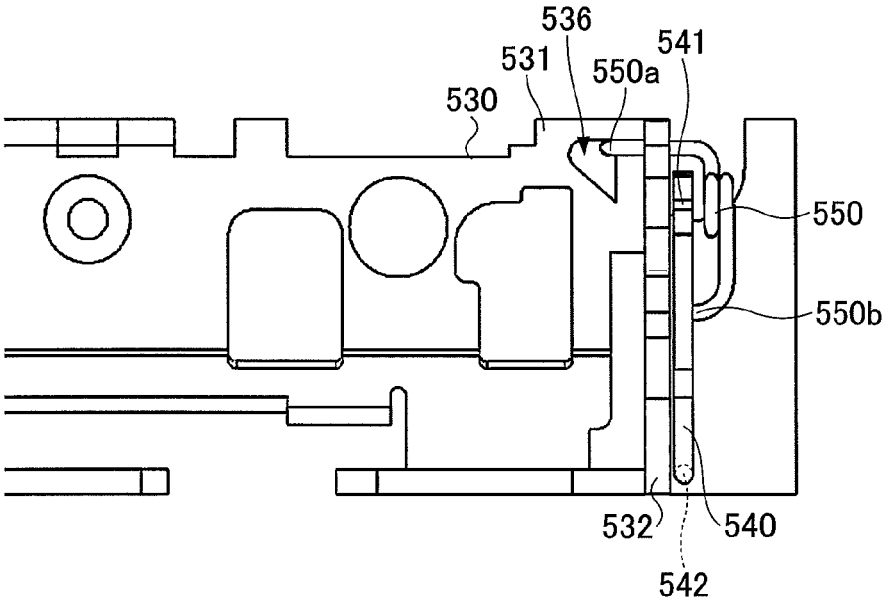
FIG. 49 is a front view of the printer according to the sixth embodiment.
Figure 50:
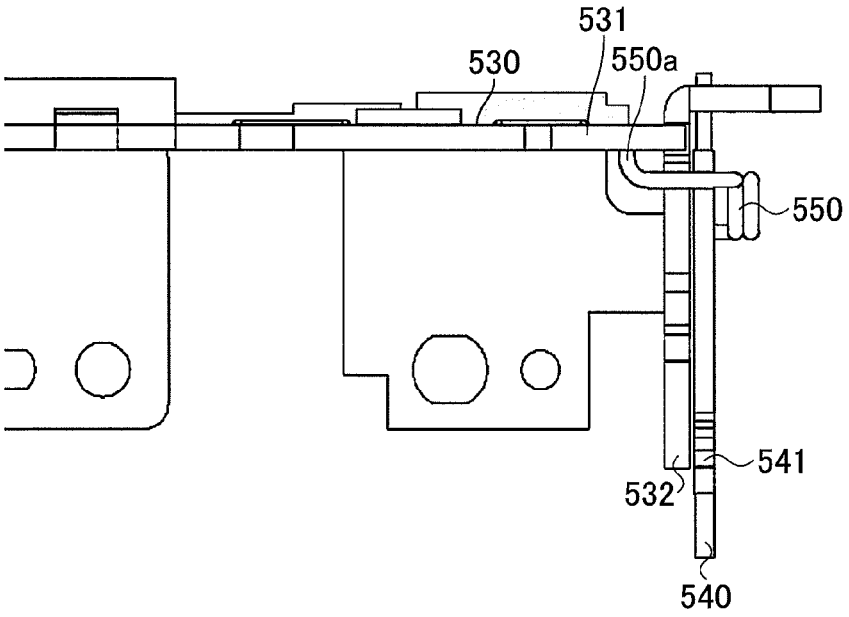
FIG. 50 is a plan view of the printer according to the sixth embodiment.

FIGS. 46 and 47 are a front view and a plan view, respectively, of the printer in a state where forces are applied to the lever caps 543 in directions to widen the interval between the release levers 540. Furthermore, FIG. 48 is a plan view of the printer in a state where the platen roller 520 has been detached from the frame 530 by applying forces to the lever caps 543 in directions to widen the interval between the release levers 540. FIGS. 49 and 50 are a front view and a plan view, respectively, of the printer in a state where the platen roller 520 is detached. In FIGS. 49 and 50, the release levers 540 are at the same positions as in FIGS. 44 and 45.

According to the printer of this embodiment, in the case of detaching the platen roller 520, forces are applied to the lever caps 543 in directions to widen the interval between the support parts 541 of the pair of release levers 540 as depicted in FIGS. 46 through 48. Specifically, by applying forces to the lever caps 543 in directions to widen the interval between the support parts 541 in an axial direction of the platen roller 520, the release levers 540 pivot on the pivot shafts 542, so that the interval between the support parts 541 of the pair of release levers 540 is widened. By thus pivoting the release levers 540, the support parts 541 move away from each other to be outside the platen caps 523 of the platen roller 520, so that the platen caps 523 and the support parts 541 are out of contact. As a result, it is possible to detach the platen roller 520.

According to the printer of this embodiment, by moving the support parts 541 of the pair of release levers 540 away from each other to the outside of the platen caps 523, the frame grooves 533 are unblocked in the direction in which the restoring forces of the coil springs 560 act (the leftward direction in FIG. 43). As a result, the platen roller 520 is pushed out of the frame 530 by the restoring forces of the coil springs 560, so that it is possible to easily remove the platen roller 520 from the frame grooves 533.

[Seventh Embodiment]

Next, a seventh embodiment is described. According to this embodiment, a release lever slides relative to a frame. A printer according to this embodiment is described with reference to FIGS. 51 through 60.

Figure 51:
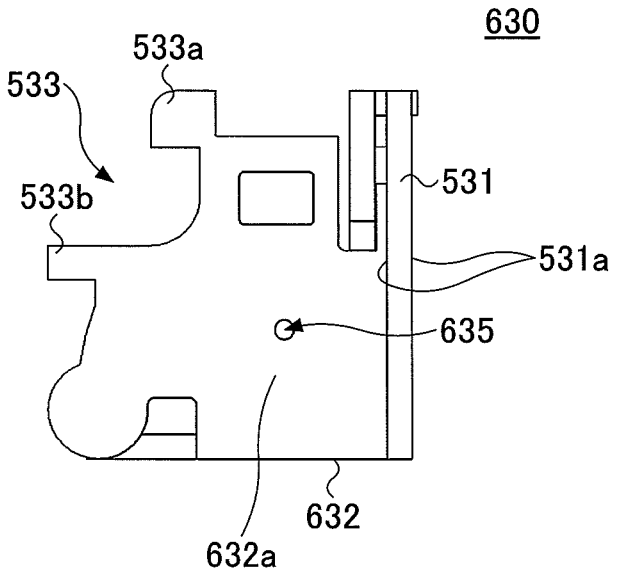
FIG. 51 is a side view of a frame of a printer according to a seventh embodiment.

FIG. 51 is a side view of a frame 630 of the printer according to this embodiment. The frame 630 includes a frame side plate 632 depicted in FIG. 51 on each end side of the frame plate 531. Each frame side plate 632 is provided with the frame groove 533 for placing the platen roller 520. Each frame groove 533 is formed in a substantial U shape between the upper support part 533*a* and the lower support part 533*b* opposite the support part 533*a* in each frame side plate 632.

Each frame side plate 632 includes surfaces 632*a* substantially perpendicular to the surfaces 531*a* of the frame plate 531. Furthermore, the same as in the sixth embodiment, the platen roller 520 is placed on the frame 630 so that an axial direction of the platen roller 520 is substantially perpendicular to the surfaces 632*a* of the frame side plates 632.

The same as in the sixth embodiment, the frame grooves 533 are open in a direction in which the restoring forces of coil springs that press the thermal head 510 act. The platen caps 523 are placed between the support parts 533*a* and the support parts 533*b*.

Furthermore, each frame side plate 632 is provided with an opening 635 for inserting a slide shaft 642 provided on each of below-described release levers 640. Furthermore, spring holes 636 for inserting ends 650*a* of below-described torsion coil springs 650 are provided in the frame plate 531 inside the frame side plates 632 as depicted in, for example, FIG. 54.

Figure 52:
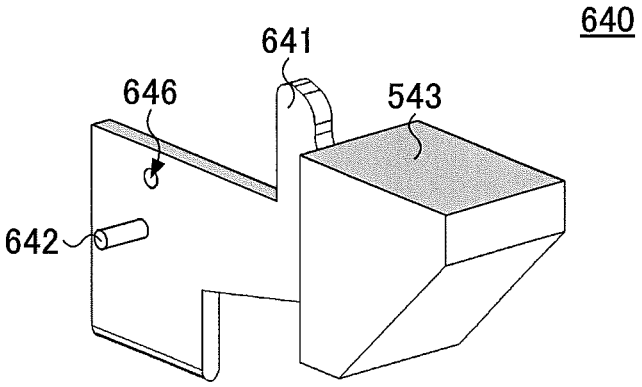
FIG. 52 is a perspective view of a release lever of the printer according to the seventh embodiment.

The release levers 640, each having a configuration as depicted in FIG. 52, are provided one outside each of the frame side plates 632 that are provided one at each end of the frame 630. Thus, according to the printer of this embodiment, the two release levers 640 in total are provided, one at each end of the frame 630, to form a pair of release levers.

Each release lever 640 has a plate-shaped body, which includes a support part 641 for supporting the platen roller 520 placed on the frame 630. Furthermore, the slide shafts 642 projecting toward the frame side plates 632 are provided on surfaces of the release levers 640 which come into contact with the frame side plates 632. The lever caps 543 are attached to the release levers 640. Furthermore, the release levers 640 are provided with respective spring holes 646 into which other ends 650*b* of the below-described torsion coil springs 650 are inserted.

Figure 53:
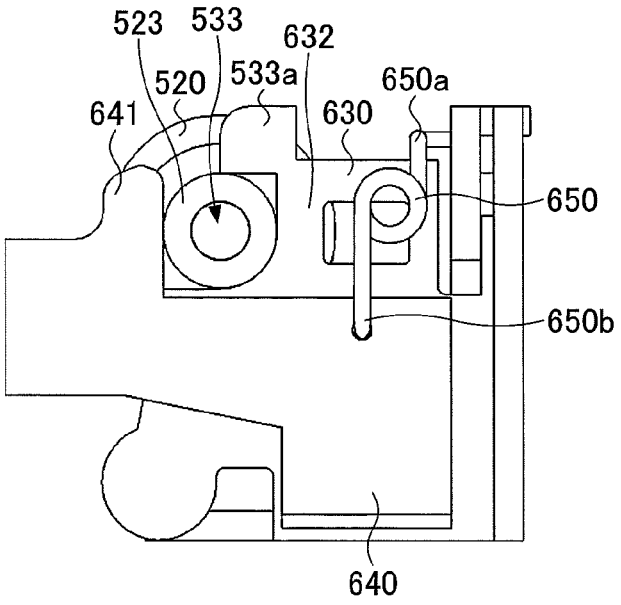
FIG. 53 is a side view of the printer according to the seventh embodiment.
Figure 54:
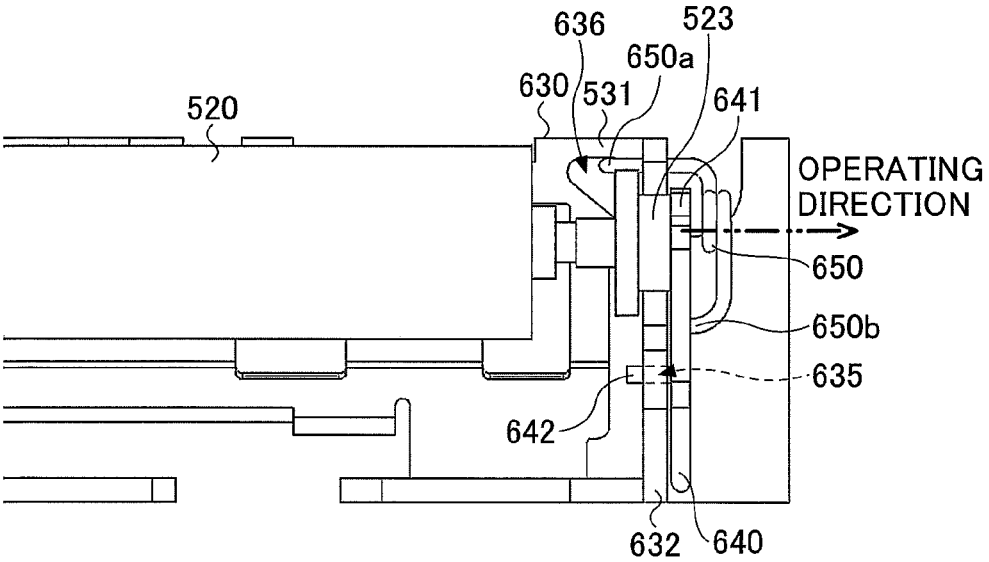
FIG. 54 is a front view of the printer according to the seventh embodiment.
Figure 55:
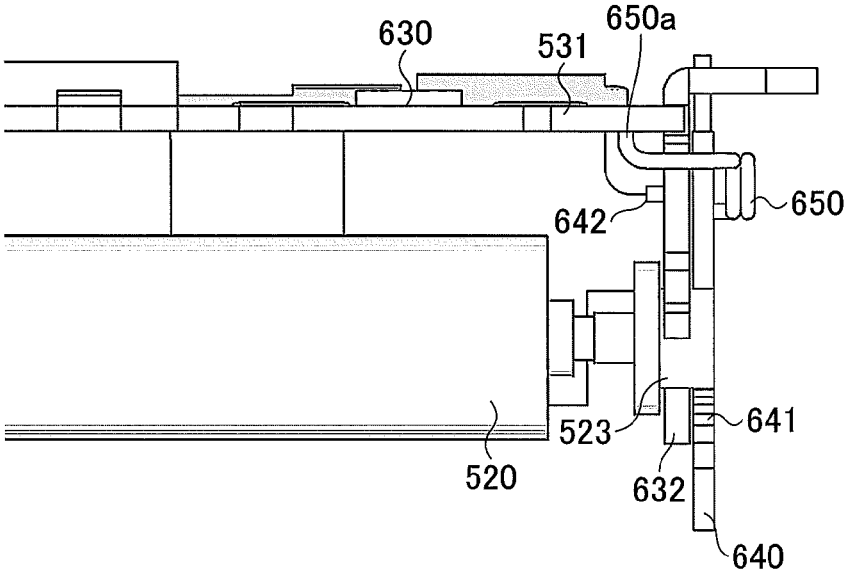
FIG. 55 is a plan view of the printer according to the seventh embodiment.

FIGS. 53, 54 and 55 are a side view, a front view, and a plan view, respectively, of the printer according to this embodiment.

As depicted in FIG. 53, according to the printer of this embodiment, the platen roller 520 is placed on the frame 530 with the platen caps 523 attached to the platen roller 520 being supported by the support parts 641 of the release levers 640 while being placed in the frame grooves 533 provided in the frame side plates 632.

The support parts 641 of the release levers 640 support the platen caps 523 on the side apposite to the thermal head 510 side of the platen caps 523. That is, the platen caps 523 are pressed toward the support parts 641 by the restoring forces of the coil springs to be supported by the support parts 641.

According to this embodiment, the platen caps 523 are supported by the support parts 533*a* and 533*b* in the frame grooves 533 with respect to directions perpendicular to the direction in which the restoring forces of the coil springs act. Furthermore, the platen caps 523 are supported by the support parts 641 of the release levers 640 with respect to the direction in which the restoring forces of the coil springs act. As a result, the platen roller 520 can be placed at a predetermined position without coming off the frame grooves 533.

According to the printer of this embodiment, as depicted in FIGS. 54 and 55, the slide shaft 642 of each release lever 640 is inserted in the opening 635 of one of the frame side plates 632, and it is possible to slide the release levers 640 away from and toward the frame side plates 632 with the slide shafts 642 being inserted in the openings 635 of the frame side plates 632.

Furthermore, each torsion coil spring 650 has the end 650*a* inserted in one of the spring holes 636 provided in the frame 630 and the other end 650*b* inserted in the spring hole 646 of one of the release levers 640. The restoring forces of the torsion coil springs 650 are exerted in directions to press the release levers 640 toward the frame side plates 632. That is, the restoring forces of the torsion coil springs 650 are exerted in directions to draw the release levers 640 toward the frame side plates 632. When the release levers 640 are not operated, the release levers 640 are substantially parallel to the frame side plates 632.

Figure 56:
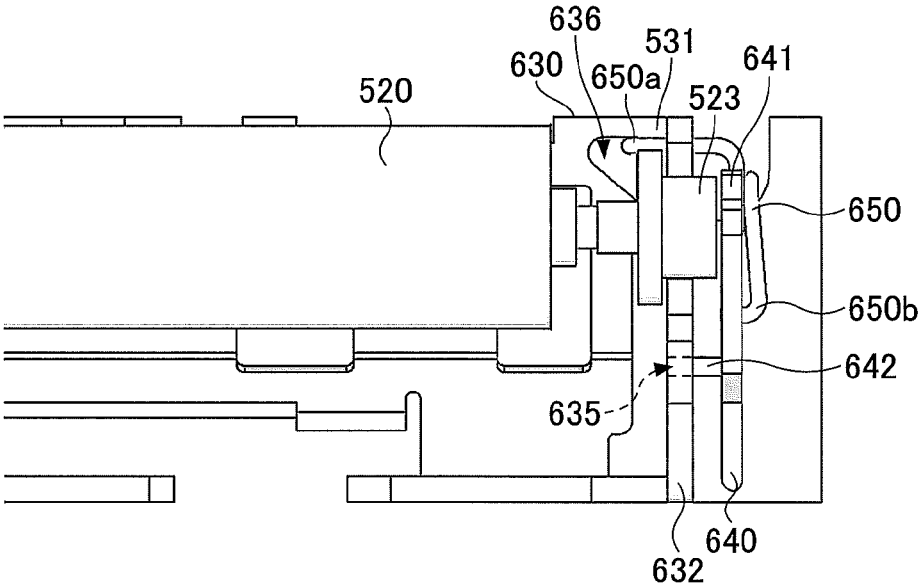
FIG. 56 is a front view of the printer according to the seventh embodiment.
Figure 57:
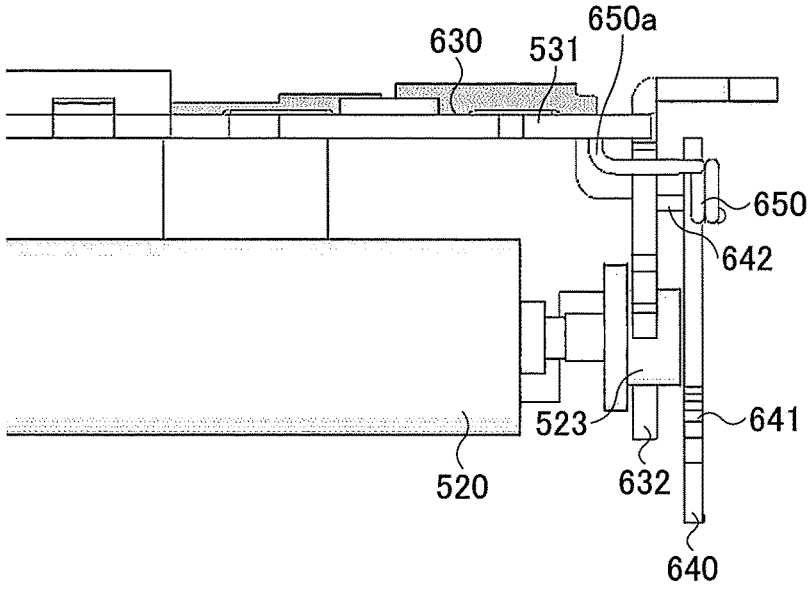
FIG. 57 is a plan view of the printer according to the seventh embodiment.

FIGS. 56 and 57 are a front view and a plan view, respectively, of the printer according to this embodiment in a state where forces are applied to the lever caps 543 in directions to widen the interval between the release levers 640.

Figure 58:
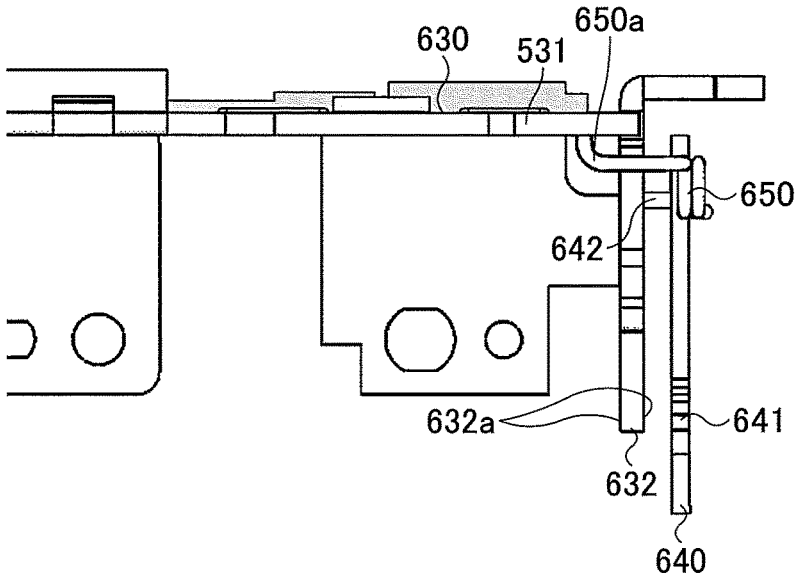
FIG. 58 is a plan view of the printer according to the seventh embodiment.
Figure 59:
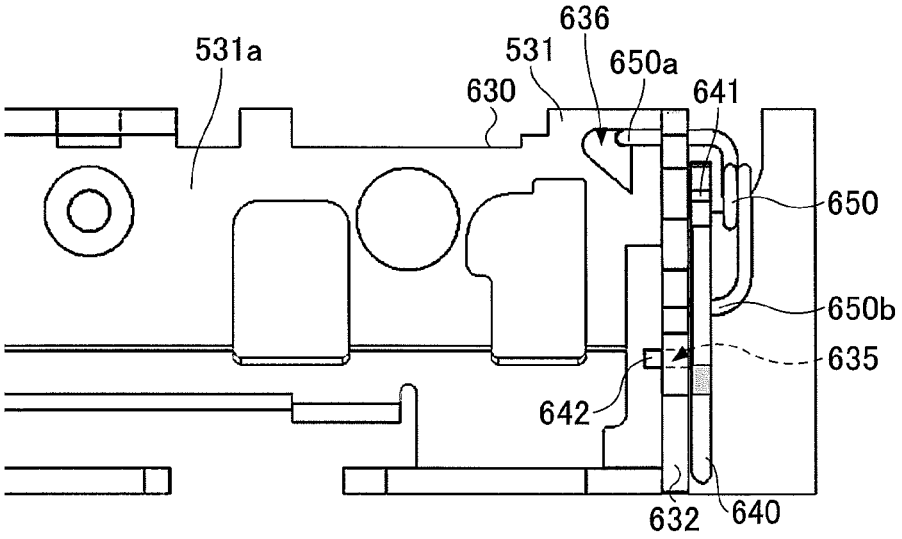
FIG. 59 is a front view of the printer according to the seventh embodiment.
Figure 60:
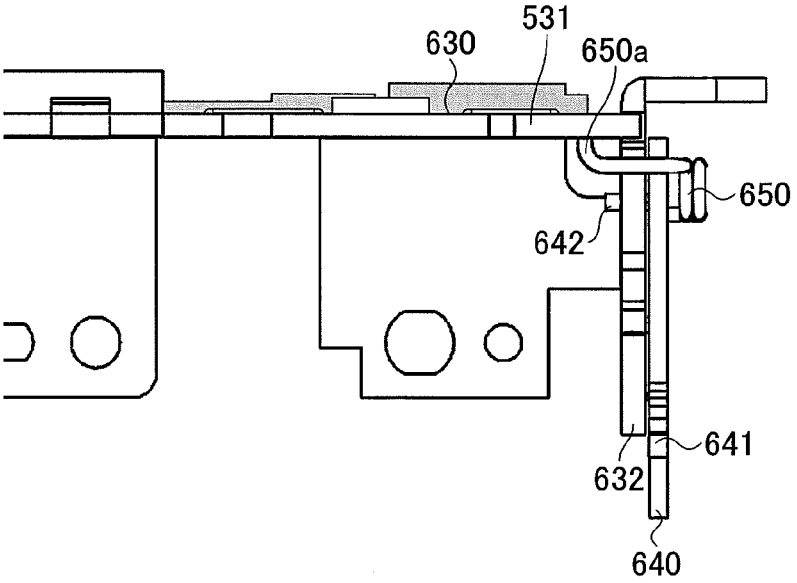
FIG. 60 is a plan view of the printer according to the seventh embodiment.

Furthermore, FIG. 58 is a plan view of the printer in a state where the platen roller 520 has been detached by applying forces to the lever caps 543. FIGS. 59 and 60 are a front view and a plan view, respectively, of the printer in a state where the platen roller 520 is detached.

According to the printer of this embodiment, in the case of detaching the platen roller 520, forces are applied to the lever caps 543 in directions to widen the interval between the support parts 641 of the pair of release levers 640 as depicted in FIGS. 56 through 58. That is, by applying forces to the lever caps 543 in directions to move the release levers 640 away from the frame side plates 632, it is possible to slide the release levers 640 with the slide shafts 642 being inserted in the openings 635 of the frame side plates 632, so that the support parts 641 of the release levers 640 move outward. By thus sliding the release levers 640, the support parts 641 of the release levers 640 move to positions outside the platen caps 523, so that the platen caps 523 and the support parts 641 are out of contact. As a result, it is possible to detach the platen roller 520.

According to the printer of this embodiment, by moving the support parts 641 of the pair of release levers 640 away from each other to the outside of the platen caps 523, the frame grooves 533 are unblocked in the direction in which the restoring forces of the coil springs act (the leftward direction in FIG. 53). As a result, the platen roller 520 is pushed by the restoring forces of the coil springs, so that it is possible to easily remove the platen roller 520 from the frame grooves 533.

In other respects than those described above, the seventh embodiment may be the same as the sixth embodiment.

[Eighth Embodiment]

Next, an eighth embodiment is described. According to this embodiment, the seventh embodiment is modified to include multiple slide shafts.

Figure 61:
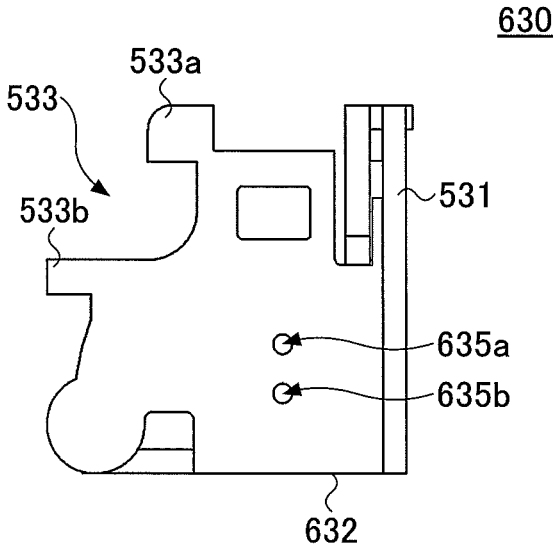
FIG. 61 is a side view of a frame of a printer according to an eighth embodiment.
Figure 62:
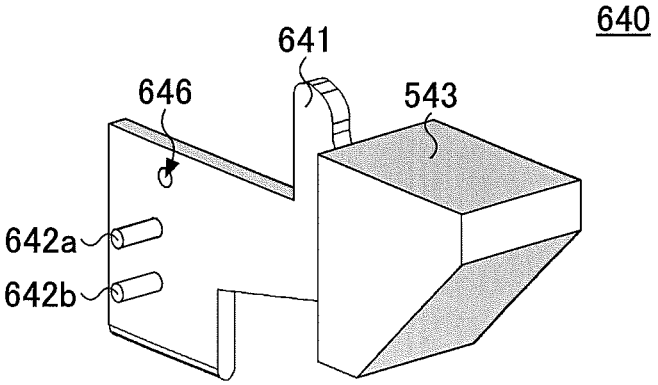
FIG. 62 is a perspective view of a release lever of the printer according to the eighth embodiment.

FIG. 61 is a side view of the frame 630 according to this embodiment. As depicted in FIG. 61, each frame side plate 632 of the frame 630 according to this embodiment is provided with an opening 635*a* and an opening 635*b* into which a slide shaft 642*a* and a slide shaft 642*b* provided on one of the release levers 640 are inserted, respectively. Furthermore, as depicted in FIG. 62, on a surface of each release lever 640 that comes into contact with one of the frame side plates 632, the slide shafts 642*a* and 642*b* projecting toward the frame side plate 632 are provided.

According to this embodiment, the slide shafts 642*a* of the release levers 640 are inserted in the openings 635*a* formed in the frame side plates 632 of the frame 630. Therefore, it is possible to slide the release levers 640 away from and toward the frame side plates 632 with the slide shafts 642*b* being inserted in the openings 635*b* of the frame side plates 632.

In the case where each release lever 640 is provided with the single slide shaft 642 as in the seventh embodiment, the release levers 640 may turn on the slide shafts 642 relative to the frame side plates 632. On the other hand, according to this embodiment, it is possible to prevent such turning of the release levers 640 by providing each release lever 640 with multiple slide shafts.

In other respects than those described above, the eighth embodiment may be the same as the seventh embodiment.

[Ninth Embodiment]

Next, a ninth embodiment is described. According to this embodiment, the seventh embodiment is modified to have a slide shaft formed to have an elongated cross-sectional shape.

Figure 63:
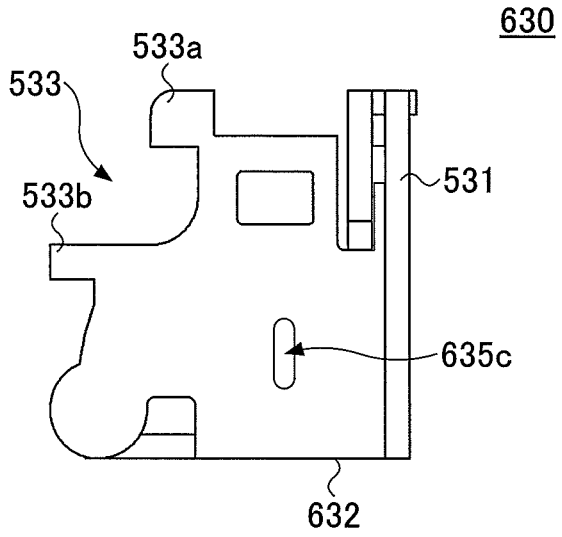
FIG. 63 is a side view of a frame of a printer according to a ninth embodiment.
Figure 64:
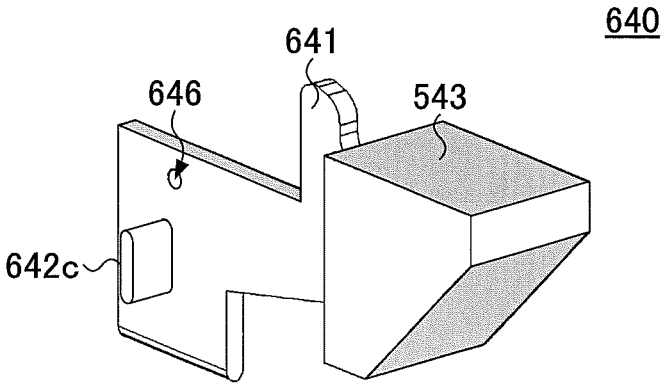
FIG. 64 is a perspective view of a release lever of the printer according to the ninth embodiment.

FIG. 63 is a side view of the frame 630 according to this embodiment. As depicted in FIG. 63, each frame side plate 632 of the frame 630 according to this embodiment is provided with an opening 635*c* into which a slide shaft 642*c* provided on each release lever 640 is inserted. Furthermore, as depicted in FIG. 64, on a surface of each release lever 640 that comes into contact with one of the frame side plates 632, the slide shaft 642*c* projecting toward the frame side plate 632 is provided. Each of the openings 635*c* provided in the frame side plates 632 has a shape corresponding to a cross-sectional shape of the slide shaft 642*c* of each release lever 640, that is, an elongated shape whose length and width are different.

According to this embodiment, it is possible to slide the release levers 640 away from and toward the frame side plates 632 with the slide shafts 642*c* of the release levers 640 being inserted into the openings 635*c* formed in the frame side plates 632 of the frame 630.

Thus, according to this embodiment, it is possible to prevent the release levers 640 from turning on respective slide shafts relative to the frame side plates 632 by forming the openings 635*c* and the slide shafts 642*c* so that each opening 635*c* and a cross section of each slide shaft 642*c* have an elongated shape having different length and width.

According to this embodiment, the openings 635*c* and cross sections of the slide shafts 642*c* may have any shape such as a square shape, as long as the shape is other than a circular shape. According to this embodiment, however, as described above, the openings 635*c* and cross sections of the slide shafts 642*c* more preferably have a shape whose length and width perpendicular to each other are different.

In other respects than those described above, the ninth embodiment may be the same as the seventh embodiment.

[Tenth Embodiment]

Next, a tenth embodiment is described. According to this embodiment, a release lever is provided at only one end of a frame. Accordingly, a printer according to this embodiment is provided with only one release lever.

Figure 65:
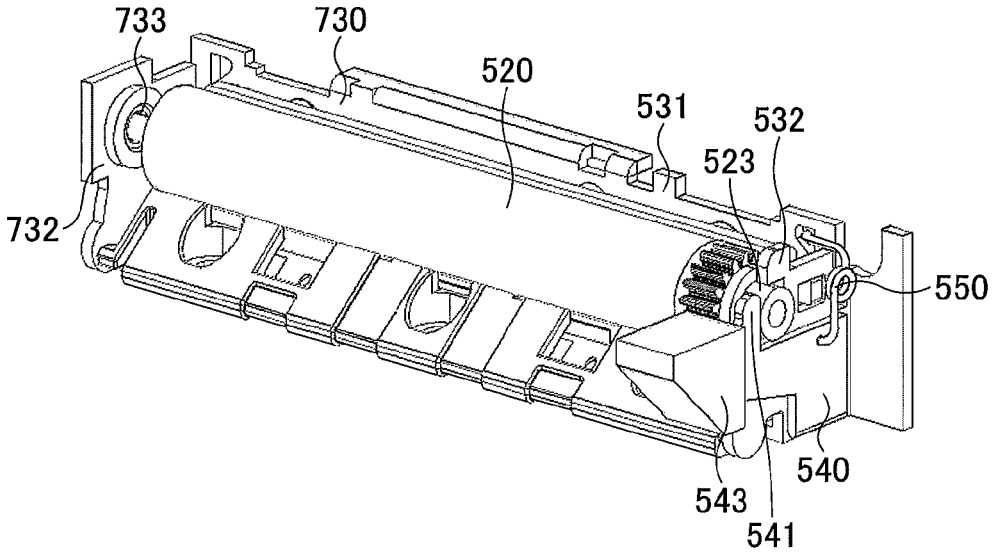
FIG. 65 is a diagram illustrating a printer according to a tenth embodiment.
Figure 66:
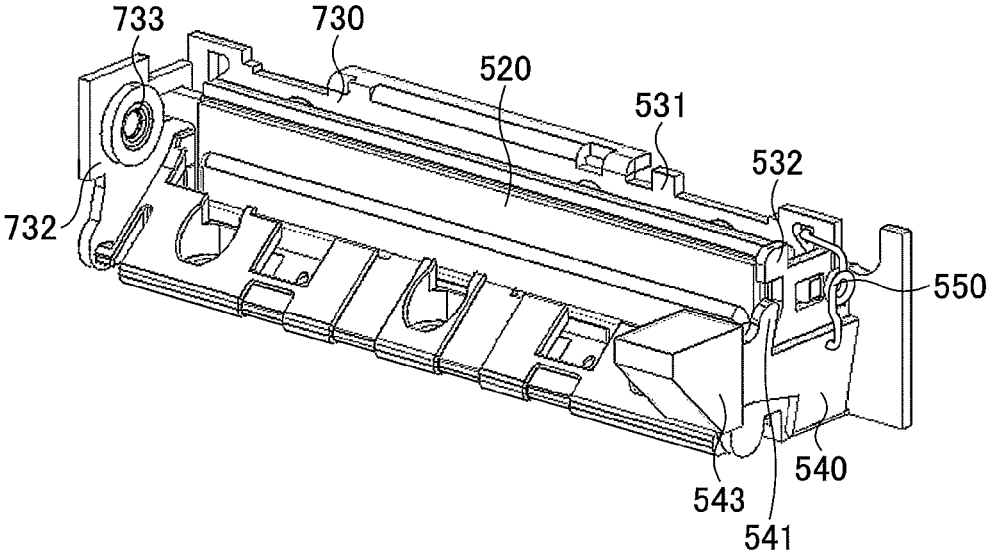
FIG. 66 is a diagram illustrating the printer according to the tenth embodiment.

FIG. 65 is a perspective view of the printer according to this embodiment, depicting a state where the platen roller 520 is provided. FIG. 66 is a perspective view of the printer according to this embodiment, depicting a state where the platen roller 520 is detached.

As depicted in FIGS. 65 and 66, a frame 730 of the printer according to this embodiment includes the frame side plate 532 at one end and a frame side plate 732 at the other end. A bearing 733 in which one end of the platen roller 520 is placed is formed in the frame side plate 732.

According to this embodiment, at the other end of the platen roller 520, the platen cap 523 is supported by the frame side plate 532 of the frame 730 and the release lever 540 the same as in the sixth embodiment.

Figure 67:
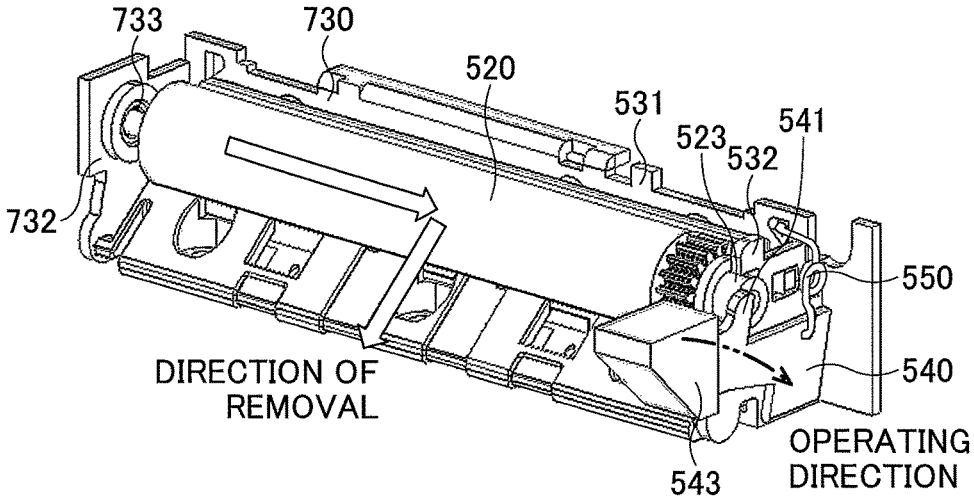
FIG. 67 is a diagram illustrating the printer according to the tenth embodiment.

That is, as depicted in FIG. 67, the platen roller 520 has the other end held by the frame side plate 532 and the release lever 540 while having the one end placed in the bearing 733 provided in the frame side plate 732.

According to the printer of this embodiment, by applying a force to the lever cap 543 provided on the release lever 540 to pivot the release lever 540 in the operating direction indicated by the two-dot chain arrow in FIG. 67 until the support part 541 of the release lever 540 is outside the platen cap 523 the same as in the sixth embodiment, it is possible to move the platen roller 520 in the direction of removal indicated by the white arrows in FIG. 67 to detach the platen roller 520 from the frame 730. Thus, according to the printer of this embodiment, it is possible to detach the platen roller 520 by operating the single release lever 540 provided at one end of the frame 730.

In other respects than those described above, the tenth embodiment may be the same as the sixth embodiment. Furthermore, the printer according to the seventh embodiment also may be configured to have a slidable release lever provided at only one end of the frame.

[Eleventh Embodiment]

Figure 68:
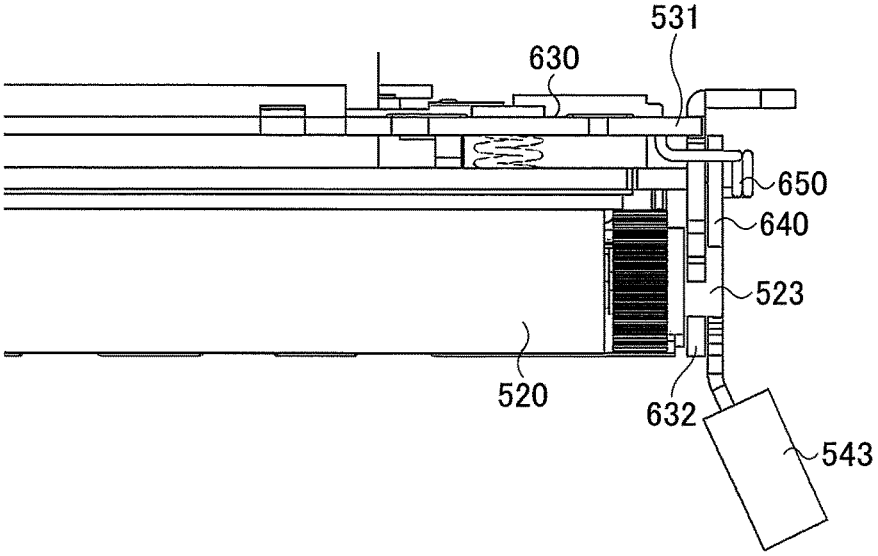
FIG. 68 is a diagram illustrating a printer according to an eleventh embodiment.

Next, an eleventh embodiment is described. According to this embodiment, part of each release lever 640 of the printer of the seventh embodiment to which part the lever cap 543 is attached is bent outward as depicted in FIG. 68. Placement of the platen roller 520 is facilitated by thus bending each release lever 640 so that part of the release lever 640 to which the lever cap 543 is attached is positioned outside.

Figure 69:
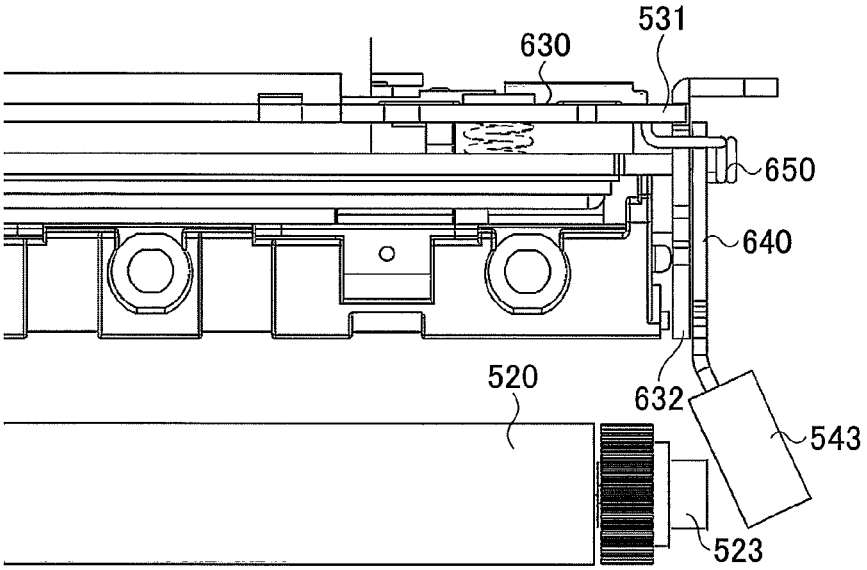
FIG. 69 is a diagram illustrating the printer according to the eleventh embodiment.
Figure 70:
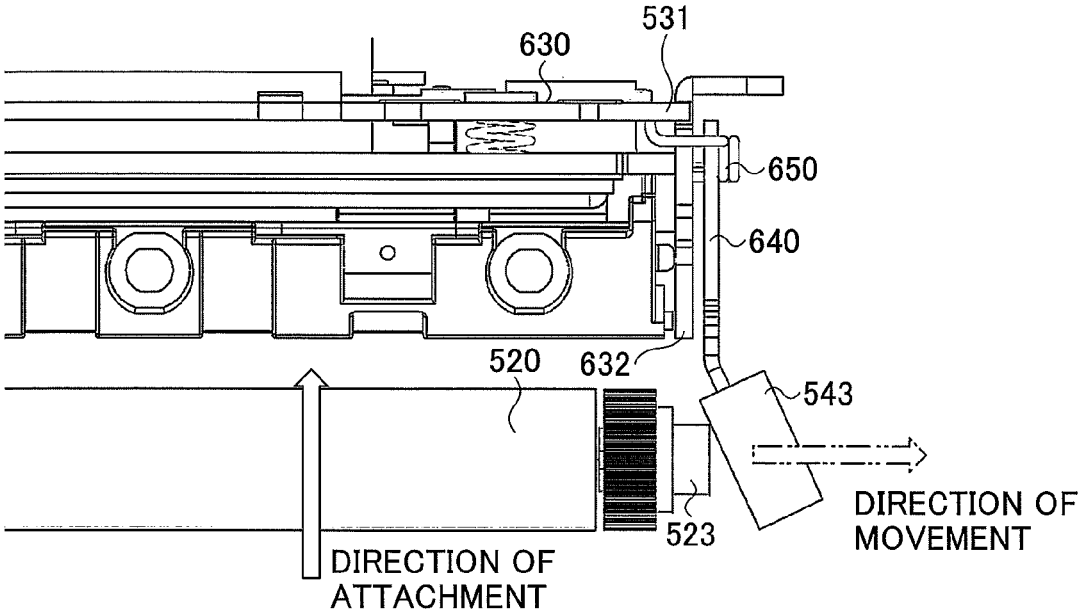
FIG. 70 is a diagram illustrating the printer according to the eleventh embodiment.
Figure 71:
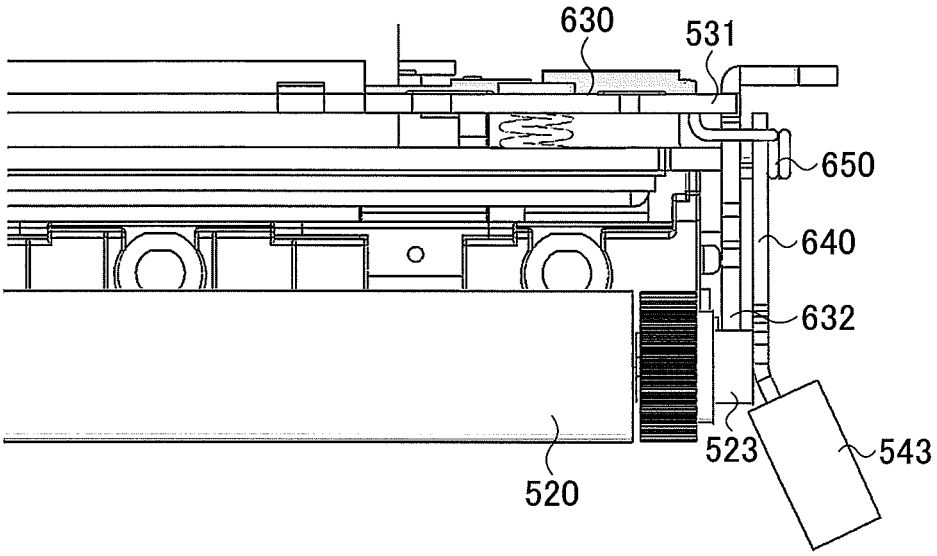
FIG. 71 is a diagram illustrating the printer according to the eleventh embodiment.

As depicted in FIG. 69, the platen roller 520, which is not placed on the frame 630, is brought close to the release levers 640. The platen roller 520 is thus brought close to the release levers 640, so that the platen caps 523 contact the lever caps 543 to press each lever cap 543 outward as indicated as the direction of movement by the two-dot chain arrow in FIG. 70. As a result, the intervals between the frame side plates 632 and the release levers 640 widen against the restoring forces of the torsion coil springs 650. Then, as a result of further moving the platen roller 520 in the direction of attachment indicated by the white arrow from the position depicted in FIG. 70 to bring the platen roller 520 closer to the release levers 640, the lever caps 543 are pressed by the platen caps 523 to further widen the intervals between the frame side plates 632 and the release levers 640 as depicted in FIG. 71. In this state, the platen caps 523 move in contact with the interior of the release levers 640. As a result, the platen roller 520 can be placed at a predetermined position in the frame 630 as depicted in FIG. 68. That is, the platen roller 520 can be held with the frame side plates 632 and the release levers 640.

In other respects than those described above, the eleventh embodiment may be the same as the seventh embodiment. Furthermore, this embodiment may also be applied to the printer according to the sixth embodiment.

Printers are described above based on embodiments. The present invention, however, is not limited to the specifically disclosed embodiments, and variations and modifications may be made without departing from the scope of the present invention.

DESCRIPTION OF THE REFERENCE NUMERALS

10, 510 thermal head
20, 520 platen roller
21, 521 roller
22, 522 platen shaft
23, 523 platen cap
24, 524 gear
30, 130, 230, 330, 530, 630, 730 frame
31, 131, 231, 331, 532, 632 frame side plate
32, 132, 232, 332, 533 frame groove
32*a*, 132*a*, 232*a*, 533*a* support part
32*b*, 132*b*, 232*b*, 533*b* support part
33, 133, 233 opening hole
40, 140, 240, 340, 540, 640 release lever
41, 141, 241, 341 lever side plate
42, 142, 242, 342, 541, 641 support part
43 lever operation part
45, 145, 245, 345, 543 lever cap
46, 420 lever groove
51 pivot shaft
52, 152, 550, 650 torsion coil spring
52*a*, 152*a*, 550*a*, 650*a* one end
52*b*, 152*b*, 550*b*, 650*b* other end
60, 560 coil spring
542 pivot shaft

The invention claimed is:

1. A printer, comprising:

a print head configured to perform printing on recording paper;

a platen roller configured to convey the recording paper held between the platen roller and the print head;

a frame on which the print head and the platen roller are placed, the frame including a side plate in which a frame groove is formed;

a release lever configured to move relative to the frame; and a spring provided between the frame and the print head to urge the print head toward the platen roller, wherein the frame groove is open in a direction in which the spring urges the print head, the platen roller is placed on the frame while being held between the frame groove and the release lever, and the release lever is configured to move to unblock the frame groove.

2. The printer as claimed in claim 1, wherein the release lever pivots about an axial direction of the platen roller.

3. The printer as claimed in claim 2, further comprising:

a lifting member pivotably connected to the frame, wherein the lifting member is configured to be pivoted by a movement of the release lever to push up the platen roller.

4. The printer as claimed in claim 2, wherein the release lever includes a side plate having a lever groove formed between a first part and a second part thereof, the platen roller is placed in the frame groove and the lever groove, and the release lever pivots to press the platen roller with one of the first part and the second part of the side plate of the release lever.

5. The printer as claimed in claim 1, wherein the release lever is configured to slide relative to the frame.

6. The printer as claimed in claim 5, wherein the direction in which the spring urges the print head is different from a direction in which the release lever slides.

7. The printer as claimed in claim 5, further comprising:

a leaf spring provided inside the frame groove, wherein the release lever is configured to slide relative to the frame to have a part of the release lever contact and pull an end of the leaf spring, so that the leaf spring stretches to push out the platen roller from the frame groove.

8. A printer, comprising:

a print head configured to perform printing on recording paper;

a platen roller configured to convey the recording paper;

a frame on which the print head and the platen roller are placed, the frame including a frame plate, and a first side plate and a second side plate provided on a first end portion and a second end portion, respectively, of the frame plate; and a release lever attached to the frame outside the first side plate to be movable in a direction away from the first side plate, wherein the platen roller is supported by the release lever and frame grooves formed in the first and second side plates, and the release lever is configured to move in the direction away from the first side plate to allow a removal of the platen roller from the frame grooves.

9. The printer as claimed in claim 8, further comprising:

an additional release lever attached to the frame outside the second side plate to be movable in a direction away from the second side plate, wherein a first end of the platen roller is supported by the release lever and a second end of the platen roller is supported by the additional release lever.

10. The printer as claimed in claim 8, wherein the release lever is attached to the frame to be pivotable in the direction away from the first side plate.

11. The printer as claimed in claim 8, wherein the release lever is attached to the frame to be slidable in the direction away from the first side plate.

12. The printer as claimed in claim 11, further comprising:

a slide shaft provided on the release lever, wherein the slide shaft is inserted in an opening formed in the first side plate.

13. The printer as claimed in claim 8, further comprising:

a spring provided between the frame and the print head to press the print head toward the platen roller, wherein the frame grooves are open in a direction of pressing of the spring.

14. The printer as claimed in claim 8, further comprising:

a lever cap for operating the release lever, wherein the lever cap is provided on a part of the release lever which is bent outward relative to the first side plate.

* * * * *